US007775615B2

(12) United States Patent
Yasuda

(10) Patent No.: US 7,775,615 B2
(45) **Date of Patent: *Aug. 17, 2010**

(54) INKJET PRINTER

(75) Inventor: Minoru Yasuda, Tokyo (JP)

(73) Assignee: Konica Minolta Holdings, Inc., Tokyo (JP)

( * ) Notice: Subject to any disclaimer, the term of this patent is extended or adjusted under 35 U.S.C. 154(b) by 311 days.

This patent is subject to a terminal disclaimer.

(21) Appl. No.: 11/532,682

(22) Filed: Sep. 18, 2006

(65) Prior Publication Data

US 2007/0070106 A1 Mar. 29, 2007

(30) Foreign Application Priority Data

Sep. 29, 2005 (JP) ..... 2005-283908

(51) Int. Cl.
*B41J 29/38* (2006.01)

(52) U.S. Cl. ..... 347/10

(58) Field of Classification Search ..... 347/9–13, 347/42, 49

See application file for complete search history.

(56) References Cited

U.S. PATENT DOCUMENTS

| | | | | |
|---|---|---|---|---|
| 6,390,602 | B1 * | 5/2002 | Katakura et al. | 347/50 |
| 6,984,016 | B2 * | 1/2006 | Silverbrook | 347/25 |
| 2005/0270329 | A1 * | 12/2005 | Hoisington et al. | 347/42 |

* cited by examiner

*Primary Examiner*—Lamson D Nguyen
(74) *Attorney, Agent, or Firm*—Lucas & Mercanti, LLP

(57) ABSTRACT

A inkjet printer including a plurality of heads installed in a staggered arrangement, and a relay board for receiving image data, a control signal conforming to each head, and a timing signal for determining timed intervals to emit ink particles from the control unit of the inkjet printer, and for sending the received image data, control signal and timing signal to the aforementioned plurality of respective drive signal generating circuits.

1 Claim, 17 Drawing Sheets

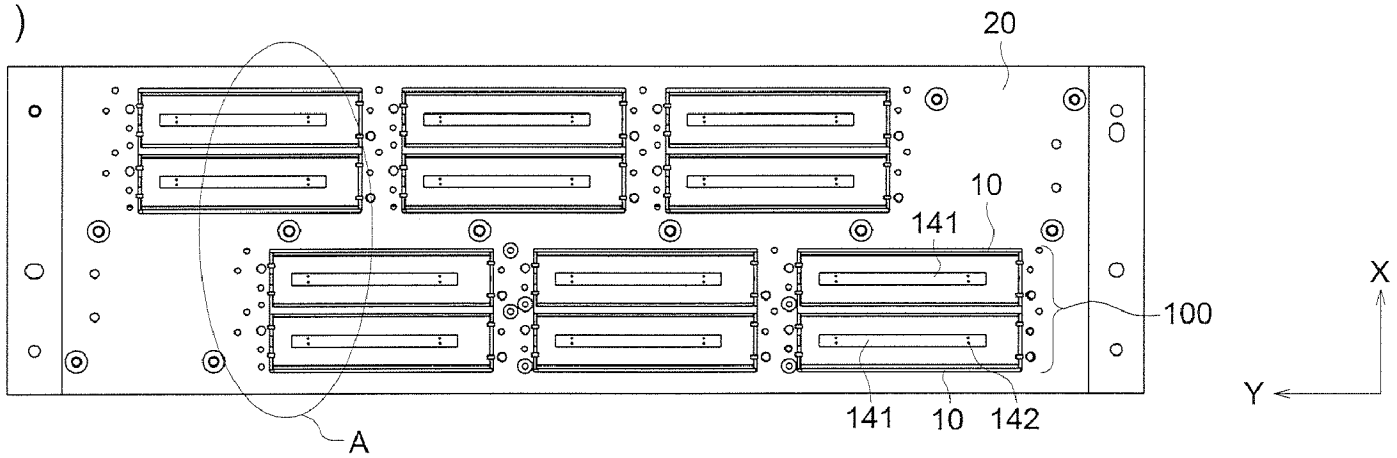
FIG. 7 ( a )
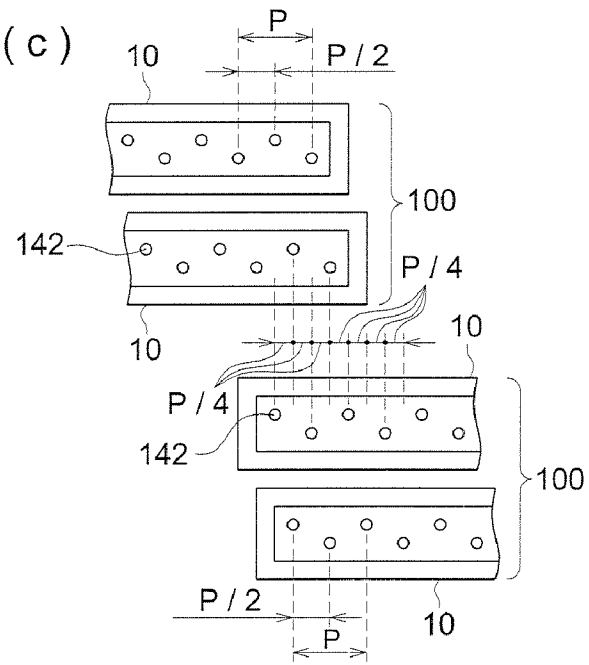
FIG. 7 ( c )
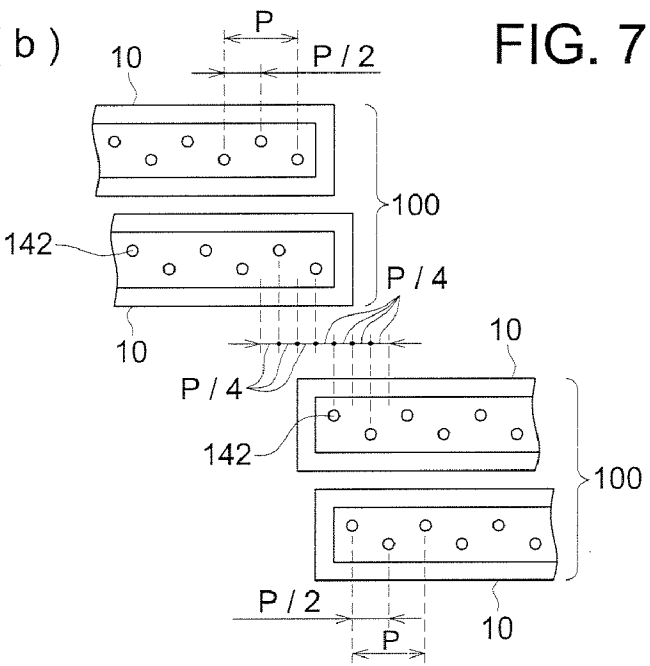
FIG. 7 ( b )

FIG. 15

REGISTER 800 802 803 804

| ADDRESS | | | | | SYMBOL | FUNCTION | RECOMMENDED VALUE | R / W | REMARKS |
|---|---|---|---|---|---|---|---|---|---|
| A04 | A03 | A02 | A01 | A00 | | D11 D10 D09 D08 D07 D06 D05 D04 D03 D02 D01 D00 | | | A00 |
| 0 | 0 | 0 | 0 | 0 | MODE | | - | R / W | 000 = NORMAL MODE<br>001 = CYCLE TRIGGER MODE<br>009 = STB RESET (STB1 FOR THE NEXT FIRE) FOR CYCLE TRIGGER MODE<br>000 WHEN POWER IS TURNED ON (NOT STORED IN THE EEPROM) |
| 0 | 0 | 0 | 0 | 1 | DALH | L-SIDE H-DRIVE VOLTAGE DA VALUE | 160 | R / W | 0.1V / digit, 0=0V, 220=22V, range 3V(30) to 22V(220) |
| 0 | 0 | 0 | 1 | 0 | DALL | L-SIDE L-DRIVE VOLTAGE DA VALUE | 80 | R / W | 0.1V / digit, 0=0V, 220=22V, range 3V(30) to 22V(220) |
| 0 | 0 | 0 | 1 | 1 | DARH | R-SIDE H-DRIVE VOLTAGE DA VALUE | 160 | R / W | 0.1V / digit, 0=0V, 220=22V, range 3V(30) to 22V(220) |
| 0 | 0 | 1 | 0 | 0 | DARL | R-SIDE L-DRIVE VOLTAGE DA VALUE | 80 | R / W | 0.1V / digit, 0=0V, 220=22V, range 3V(30) to 22V(220) |
| 0 | 0 | 1 | 0 | 1 | Phase_LEN | TIME INTERVAL BETWEEN PHASES A AND B, AND BETWEEN PHASES B AND C | 610 | R / W | set > 2, (drop_period + 2) * (N - 3) |
| 0 | 0 | 1 | 1 | 0 | drop_period | TIME INTERVAL BETWEEN DROPS | 120 | R / W | set > 2 |
| 0 | 0 | 1 | 1 | 1 | GS_LEV | GRADATION LEVEL | 3 | R / W | set0 < GS_LEV < =3 |
| 0 | 1 | 0 | 0 | 0 | H_WIDTH | H-DRIVE PULSE WIDTH | 30 | R / W | set > 2 |
| 0 | 1 | 0 | 0 | 1 | P_DLY | DELAY BETWEEN H-DRIVE PULSE WIDTH AND L-DRIVE PULSE | 0 | R / W | |
| 0 | 1 | 0 | 1 | 0 | L_WIDTH | L-DRIVE PULSE WIDTH | 60 | R / W | set > 2 |
| 0 | 1 | 0 | 1 | 1 | N - 1 | NUMBER OF DROPS AT GRADATION LEVEL "1" | 1 | R / W | |
| 0 | 1 | 1 | 0 | 0 | N - 2 | NUMBER OF DROPS AT GRADATION LEVEL "2" | 3 | R / W | |
| 0 | 1 | 1 | 0 | 1 | N - 3 | NUMBER OF DROPS AT GRADATION LEVEL "3" | 5 | R / W | |
| 0 | 1 | 1 | 1 | 0 | THM | THERMISTER VOLTAGE SET VALUE | | R / W | 3.3 / 256V / digit, 0=3.3 / 256V, 255=3.3V |
| 0 | 1 | 1 | 1 | 1 | STAT | STATUS | | R | D10:STB3L, D09:STB2L, D08:STB1L,<br>D06:STB3R, D05:STB2R, D04:STB1R,<br>D03..D01:reserved,<br>D00=1 : Busy(EEPROM AND DAC BEING SET, ETC.) |
| 1 | 0 | 0 | 0 | 0 | - | reserved | - | - | |
| 1 | 0 | 0 | 0 | 1 | THERM | THERMISTER AD READ VALUE | | R | 3.3 / 256V / digit |
| 1 | 0 | 0 | 1 | 0 | Therm-ad | START OF THERMISTER AD CONVERSION | | W | START OF A/D CONVERSION (ANY VALUE CAN BE WRITTEN) |
| 1 | 0 | 0 | 1 | 1 | - | reserved | - | - | |
| 1 | 0 | 1 | 0 | 0 | - | reserved | - | - | |
| 1 | 0 | 1 | 0 | 1 | - | reserved | - | - | |
| 1 | 0 | 1 | 1 | 0 | - | reserved | - | - | |
| 1 | 0 | 1 | 1 | 1 | - | reserved | - | - | |
| 1 | 1 | 0 | 0 | 0 | - | reserved | - | - | |
| 1 | 1 | 0 | 0 | 1 | - | reserved | - | - | |
| 1 | 1 | 0 | 1 | 0 | - | reserved | - | - | |
| 1 | 1 | 0 | 1 | 1 | - | reserved | - | - | |
| 1 | 1 | 1 | 0 | 0 | - | reserved | - | - | |
| 1 | 1 | 1 | 0 | 1 | - | reserved | - | - | |
| 1 | 1 | 1 | 1 | 0 | SN | SERIAL NUMBER | | R | |
| 1 | 1 | 1 | 1 | 1 | VER | VERSION | | R | D11..D05 : MAJOR NUMBER ., D04..D00 : MINOR NUMBER |

INKJET PRINTER

BACKGROUND OF THE INVENTION

1. Field of the Invention

The present invention relates to an inkjet printer, particularly to a line type inkjet printer wherein a plurality of nozzles are arranged over the length corresponding to the width of a printing medium and ink is emitted from these nozzles to the aforementioned printing medium, whereby an image is printed.

2. Description of the Related Art

In some of the inkjet printers according to the conventional art, fine ink particles are emitted to a printing medium from the nozzle of an inkjet head in response to the emission control of an image signal, and at the same time, the inkjet head is moved in the main scanning direction to perform image printing for one line. Then the printing medium is shifted by one line in the sub-scanning direction and fine ink particles are again emitted from the inkjet head nozzle to the printing medium to perform image printing for one line. This procedure is repeated, thereby forming an image on the printing medium.

In another inkjet printer according to the conventional art, the inkjet head is designed in a longer type wherein the ink emitting nozzles are arranged at an equally spaced pitch over approximately the maximum printing width of a printing medium, so that the inkjet head constitutes a line head secured on the apparatus proper. This structure eliminates the need of the inkjet head moving in the main scanning direction, and permits an image to be formed merely by conveying the printing medium in the sub-scanning direction, the printing medium being perpendicular to the main scanning direction. This arrangement ensures high-speed image formation.

However, because of high-speed image formation, the printing resolution in the main scanning direction is determined by the nozzle pitch of the line head when an image is formed by only one step of conveyance in the sub-scanning direction. Thus, to provide a finer pitch of printing dots in the main scanning direction, the line head nozzles could be arranged at still finer pitches, thereby getting a finer dot pitch. However, there is a limit to machining when making the nozzle pitch finer. Hence there is a limit to printing precision that could be achieved by a finer dot pitch. This method further involves problem of increased costs.

The following line head is proposed in the Japanese Non-Examined Patent Publication 11-34360. According to this document, to improve the printing precision in the main scanning direction, a plurality of the printing heads having nozzles arranged in a straight line are provided in the sub-scanning direction. Each printing head is sequentially displaced in the main scanning direction by a fraction of one printing head with a space L between the aforementioned nozzles, whereby a set of inkjet heads is formed. A plurality of sets of inkjet heads are oriented across the width of the paper, and are placed in staggered arrangement over the entire width of paper compactly without leaving any space.

However, in the line head disclosed in the Japanese Non-Examined Patent Publication 11-34360, a plurality of printing heads with the nozzles arranged in a straight line are displaced in the main scanning direction, whereby a set of inkjet heads is formed. Thus, to improve the printing precision, multiple printing heads must be arranged. However, each printing head is a inkjet head having been manufactured independently, and therefore, each printing head must be positioned so as to adjust the positions of nozzle surfaces of all the printing heads. This involves a problem of complicated assembling work to be performed.

Each printing head is an independently completed inkjet head. Assembling of these heads results in a large-sized inkjet head in the final stage.

Furthermore, when the head is replaced, a complicated work procedure is required in reassembling the head by positioning.

SUMMARY OF THE INVENTION

The object of the present invention is to solve the aforementioned problems.

Another object of the present invention is to provide a line type inkjet printer characterized by compact configuration and a high degree of assembling productivity.

A further object of the present invention is to provide a line type inkjet printer characterized by easy positioning among a plurality of heads.

These and other objects are attained by an inkjet printer having; a line head made up of a plurality of heads having a plurality of nozzles for emitting ink particles, these heads being installed in a staggered arrangement; a plurality of drive signal generating circuits provided for each head to output a drive signal to each head; and a relay board for receiving image data, a control signal conforming to each head, and a timing signal for determining timed intervals to emit ink particles from the control unit of the inkjet printer, and for sending the received image data, control signal and timing signal to the plurality of respective drive signal generating circuits.

The invention itself, together with further objects and attendant advantages, will best be understood by reference to the following detailed description taken in conjunction with the accompanying drawings.

BRIEF DESCRIPTION OF THE DRAWINGS

FIG. 7 (*a*) is a drawing representing the line head 2 as viewed from the nozzle;

FIGS. 7(*b*) and 7 (*c*) are enlarged views showing the circled portion A of FIG. 7 (*a*);

FIG. 15 is a diagram showing the control conditions stored in the register of the nonvolatile memory 502;

In the following description, like parts are designated by like reference numbers throughout the several drawing.

DESCRIPTION OF THE PREFERRED EMBODIMENT

Figure 1:
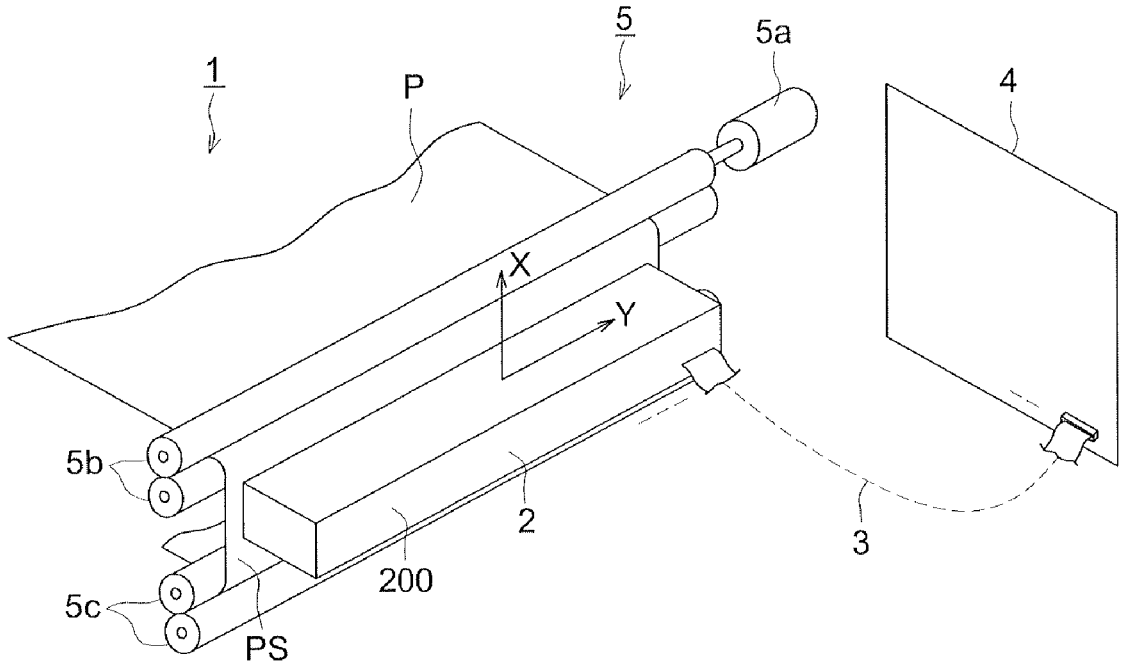
FIG. 1 is a perspective view representing the major portion of an inkjet printer.

The following describes the embodiments of the present invention with reference to drawings:

FIG. 1 is a perspective view representing the major portion of an inkjet printer of the present invention. The line type inkjet printer performs image printing by relative movement of the line head and printing medium in the sub-scanning direction. The relative movement of the line head and printing medium in the sub-scanning direction will be described using an example of the type wherein the line head is stationary and the printing medium is moved in the sub-scanning direction. It is also possible to move the line head in the sub-scanning direction.

The reference numeral 2 in FIG. 1 denotes a line head installed on the inkjet printer. As will be described later in details, it is connected with a control board 4 of the apparatus proper through a flexible cable 3. The line head 2, except for the surface opposed to the printing medium P, is protected by a cover 200. The details of this structure will be described later. When full-color image printing is performed, line heads for emitting Y, M, C and K colors, for example, are arranged. The following describes the case of containing only one line head 2 for ease of explanation.

The printing medium P is sandwiched between a pair of conveyance rollers 5*b* and 5*c* of the printing medium conveyance mechanism 5 for conveying the printing medium P. The conveyance motor 5*a* is directly coupled with the shaft of the conveyance roller 5*b*. When the conveyance roller 5*b* is driven and rotated, the printing medium P is conveyed in the direction marked by arrow X in the drawing at a predetermined speed.

The line head 2 between the pair of conveyance rollers 5*b* and 5*c* is installed opposed to the surface PS of the printing medium P as illustrated, and the longitudinal direction is the arrow-marked direction perpendicular to the direction in which the printing medium P is conveyed as indicated by an arrow mark X.

In this line head 2, multiple nozzles are arranged at an equally spaced interval over the length corresponding to the width of the printing medium P in the direction Y on the surface (hidden in this drawing) opposed to the surface PS of the printing medium P. When ink is emitted to the printing medium P from the multiple nozzles in response to the image signal coming from the control board 4, printing medium P is conveyed in the direction marked by arrow X, and at the same time, an image is formed on the surface PS of the printing medium P. To be more specific, printing is completed in a predetermined image formation area in one step of conveyance, whereby an image is formed at high speed.

Ink is supplied to the line head 2 from an intermediate tank 306 (not illustrated) through an ink supply tube 6. The structure of the ink supply system will be described later.

Figure 2:
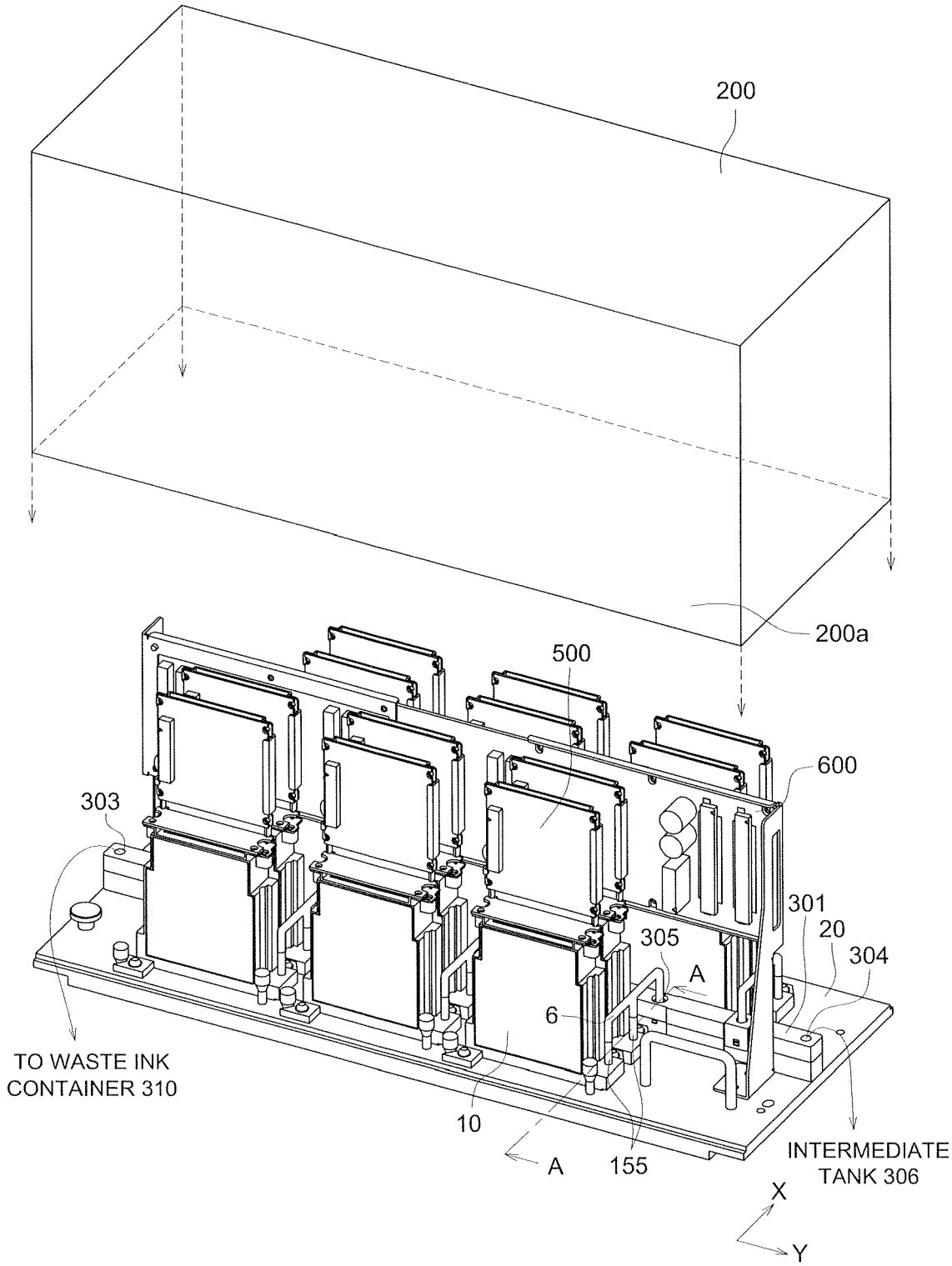
FIG. 2 is a perspective view of an inkjet printer wherein the cover of the line head 2 is removed.
Figure 3:
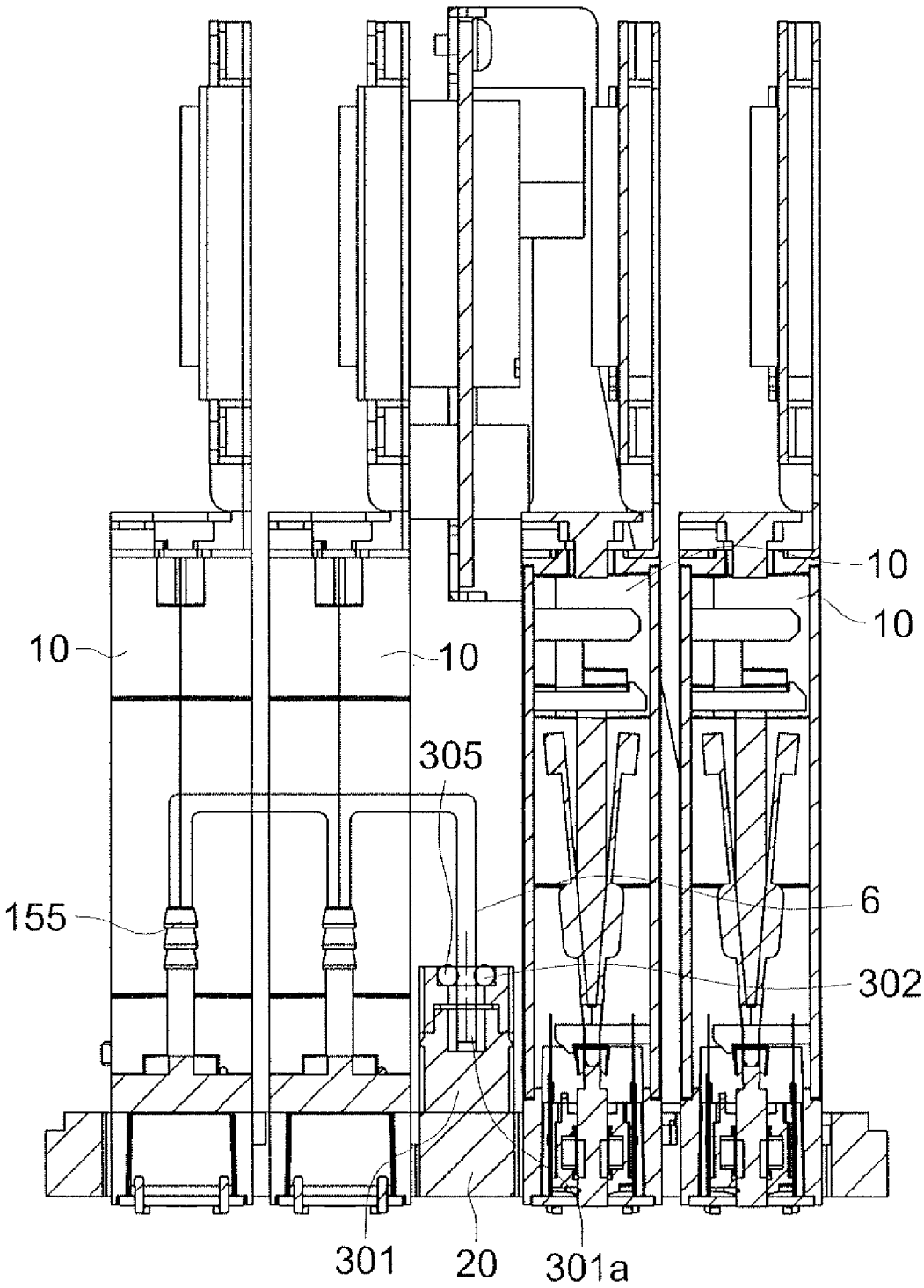
FIG. 3 is a cross sectional view showing the ink supply section to supply ink to the head module of a line head 2.
Figure 4:
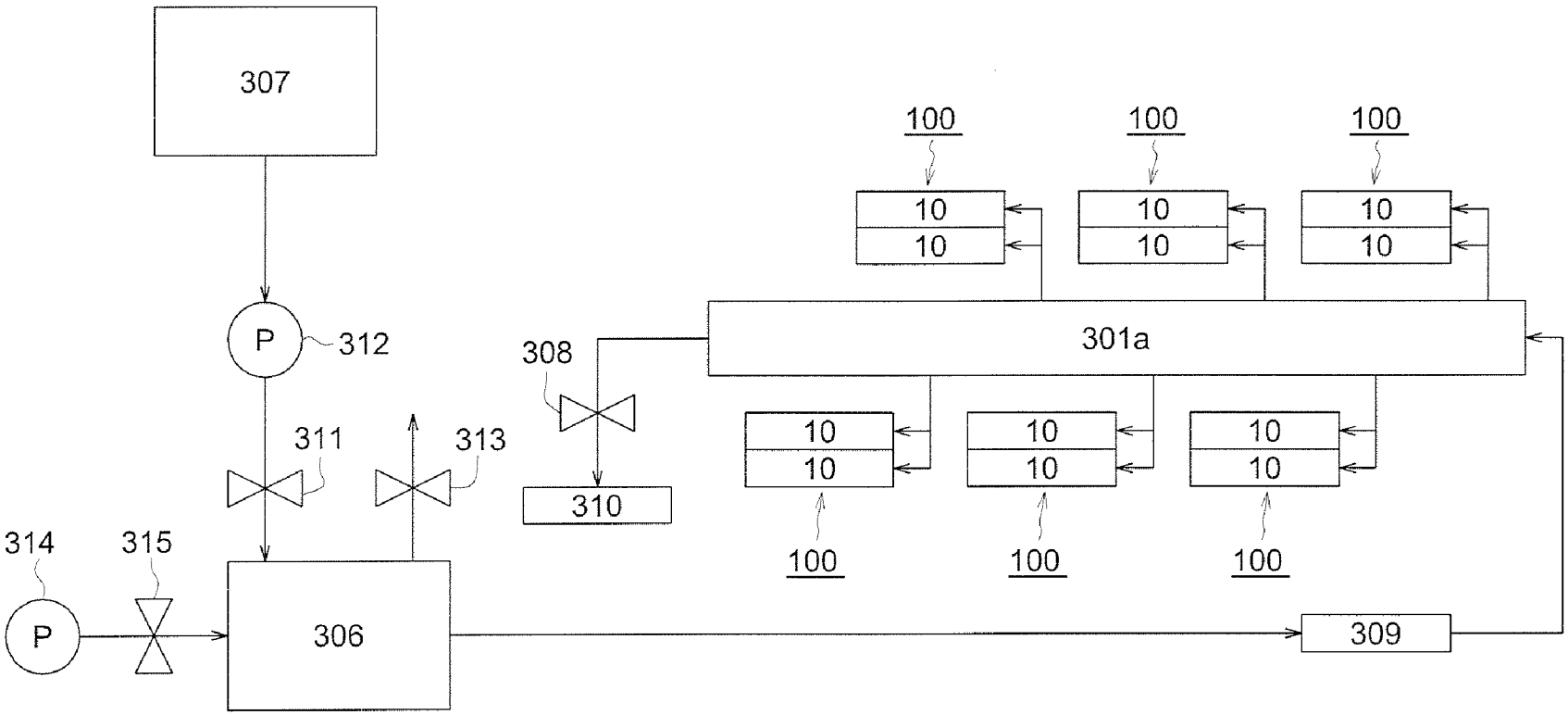
FIG. 4 is a block diagram showing the ink supply section to supply ink to the line head 2.

FIG. 2 is a perspective view of an inkjet printer wherein the cover of the line head 2 is removed. Multiple nozzles are arranged on the lower side (not illustrated in FIG. 2). FIG. 3 is a cross sectional view taken along A-A of FIG. 2. FIG. 4 is a block diagram showing the ink supply section to supply ink to the line head 2. Ink supply tubes are used for the connection of the constituents of the ink supply system.

A cover 200 is designed in a box form having an opening 200*a*, and is mounted from the side opposite to the surface of the line head 2 containing a nozzle (lower surface in FIG. 2) so as to hang over the entire line head 2. A support substance 20 is secured by a fixing device such as a screw (not illustrated). The cover 200 is preferably made of a metal such as aluminum.

The line head 2 is provided with a plurality of head modules 100 in staggered arrangement in two rows, and is mounted on a common support substrate 20. In the illustrated example, the head module 100 is mounted on the common support substrate 20, thereby constituting one line head 2. No restriction is imposed on the number of the head modules 100 constituting one line head 2.

When each of the head modules 100 constituting one line head 2 is mounted on one common support substrate 20, a common mounting surface can be used for each of the head modules 100. This arrangement preferably ensures a high positioning precision of the nozzle row of the head module 100.

Each head module 100 is made up of a set of n-heads 10 (wherein n denotes an integer of 2 or more). Since this structure is adopted, if the head module 100 happens to contain a faulty nozzle 142 which cannot be recovered by the process of recovery alone, only the head 10 containing the aforementioned nozzle should be removed and replaced by a new head 10. This procedure allows the nozzle function to be recovered. This arrangement eliminates the need of removing all the entire head modules 100 and replacing them, and provides a substantial reduction in the replacement cost, thereby improving the reliability at a reduced cost.

The illustrated example shows one head module 100 formed of two heads 10 (where n=2). When the number of heads 10 constituting one head module 100 is "n", there is no restriction if "n" is an integer of 2 or more. However, when consideration is given to making a compact configuration of the line head, "n" is preferably an integer not exceeding 6.

Further, if staggered arrangement is adopted, the space between head modules 100 adjacent in each stage can be increased. Thus, mounting or dismounting of each head 10 can be performed without being interrupted by the adjacent head modules 100, with the result that the work is facilitated. Further, this arrangement also facilitates the adjustment of the nozzle pitch between adjacent head modules 100.

Each of the heads 10 constituting the head module 100 is mounted on the aforementioned support substance 20, with the tip end on the nozzle side being inserted in the mounting hole 22 (FIG. 11) of the common support substrate 20.

Each of the heads 10 has a head (nozzle) position adjusting mechanism to be described later. Accordingly, a gap is produced between the aforementioned mounting hole 22 and head 10. This gap allows the head 10 to travel along the XY plane, and permits the head position to be adjusted. To fill this gap, a sponge-like sheet 321 as an elastic member is arranged inside the mounting hole 22 (inner peripheral surface). A urethane foam is preferably used as a sponge-like sheet.

In an inkjet printer wherein ink is emitted from a fine nozzle to a printing medium to perform printing, a so-called ink mist is produced at the time of printing, wherein fine ink particles suspend around the printing section. The ink mist is deposited on the electrical substrate, thereby damaging the electrical substrate in some cases. Except for the nozzle surface of the line head 2, almost all the line heads 2 in the present Example are covered with the cover 200, common support substrate 20 and sponge-like sheet 321. This arrangement protects the internal electrical substrate against ink mist. Further, the sponge-like sheet 321 protects against the ink mist when a gap for adjusting the head position of each head 10 to be described later is provided.

The ICB substrate 500 contains a drive signal generating circuit. It is a substrate to convert various signals for driving the head 10, generated by the control board 4 into the signal or power supply voltage in response to the structure of the head 10. In the present Example, substrates having such function will be described below under the name of an ICB substrate 500.

The relay substrate 600 is connected with the control board 4 of the apparatus proper through a flexible cable 3. Receiving various control signals and image data from the control board 4, the relay substrate 600 sends them to the ICB substrate 500 provided for each head 10 connected through the flexible cable (not illustrated). The ICB substrate incorporates a drive signal generating circuit.

Each head 10 contains two head driving boards 146 to be described later and is connected with two head driving boards 146 and ICB substrates 500. Receiving various control signals and image data from the relay substrate 600, the ICB substrate 500 generates various signals for driving the head 10 and distributes them to the two head driving board 146.

As compared to the case where each head 10 is connected with the control board 4 through the flexible cable in an electrically independently manner, the aforementioned arrangement simplifies the connection. Even when a head of different specifications is utilized, it can be easily made compatible if various signals conforming to the head specifications are generated within the ICB substrate 500.

The common support substrate 20 is provided with a common ink flow path forming member 301 between the two-row head modules 100 which are installed in staggered arrangement. A common ink flow path 301*a* is formed integrally inside the common ink flow path forming member 301. One end of the common ink flow path 301*a* is provided with an ink inlet 304, while the other end is equipped with a bubble outlet 303.

As described above, a common ink flow path 301*a* is arranged in the dead space between the two-row head module 100. This contributes to effective use of the dead space, and hence reduces the space occupied by the line head and ink supply system in the inkjet printer. Thus, this arrangement provides a compact apparatus, for example, as compared to the case where an ink supply tube is provided for each head 10, and is connected independently with ink tank. The common support substrate 20 and common ink flow path forming member 301 can be made of the same or different materials, if only they are formed integrally with each other.

The ink inlet 304 is connected with an intermediate tank 306 through a filter 309, and ink is supplied from the intermediate tank 306.

The intermediate tank 306 is connected with the ink cartridge 307 through a valve 311 and pressure pump 312, and can communicate with atmospheric air through a valve 313. Further, it is connected with a pressure pump 314 through a valve 315.

The bubble outlet 303 is connected with a waste ink container 310 through the valve 308.

In the common ink flow path 301*a*, a required number (six in the present Example) of branched supply inlets 305 for supplying ink to each head module 100 are provided between the ink inlet 304 and bubble outlet 303 at a position corresponding to each head module 100.

The two heads 10 constituting each head module 100 is provided with a frame ink flow path 155 for each head 10, and are connected with the branched supply inlet 305 and two frame ink flow paths 155 through an ink supply tube 6.

As described above, six head modules 100 are supplied with ink from one intermediate tank 306 for determining the back pressure of six head modules 100 through the common ink flow path 301*a*.

Each head module 100 is combined with two heads 10. The head unit 10 is supplied with the ink contained in the intermediate tank 306 through the ink supply tube 6 and common ink flow path 301*a*. Further, on the upstream side of the intermediate tank 306, an ink cartridge 307 is connected therewith through a valve 311 and pressure pump 312.

As described above, the ink cartridge 307 is preferably arranged common to all the head modules 100. This arrangement facilitates replacement of the ink cartridge. In other words, if each head module is equipped with an ink cartridge, different coloring in printing may result among head modules due to variations of ink.

Further, the back pressure of each head module 100 is preferably determined by the intermediate tank 306. The intermediate tank 306 provided with a container including a flexible bag or an atmosphere-communicating valve 313 as in the present Example is installed below the ink cartridge 307 through a valve 311 and pressure pump 312. If the atmosphere-communicating valve 313 is opened and the valve 311 is closed, then ink in the intermediate tank 306 will have an atmospheric pressure. When the intermediate tank is placed below the head module by a predetermined height, the ink of the head will have the pressure which is negative with reference to the atmospheric pressure by a predetermined difference of head, whereby stable ink emission is achieved. The intermediate tank is equipped with a residual amount detector or empty state detector. If the amount of ink has reduced below a predetermined level, the valve 311 opens to actuate the pressure pump 312 and ink is supplied to the intermediate tank 306 from the ink cartridge 307. If the intermediate tank 306 is not replenished with ink after the lapse of more than predetermined time subsequent to opening of the valve 311 and operation of the pressure pump 312, the detector determines that the ink cartridge 307 is empty. This arrangement permits detection of the empty state of the ink cartridge 307 without being adversely affected by the fluctuation in back pressure resulting from fluctuation in the amount of remaining ink, as compared to the case where the back pressure is determined directly according to the position of the ink cartridge 307. In addition to this advantage, the aforementioned arrangement also ensures that, when replacing the ink cartridge 307, replacement of the ink cartridge 307 and printing operation can be performed simultaneously, using the ink remaining in the intermediate tank 306, without interrupting the printing operation.

As described above, an intermediate tank 306 is preferably provided as a common tank for all the head modules 100. If each head module 100 has an intermediate tank 306, a change in the head emission characteristics among the head modules 100 may be produced by the difference in position of the intermediate tank 306, and different coloring among printing media may result.

As shown in FIG. 3, the inlet of the ink supply tube 6 on the common ink flow path 301*a* is provided with an O-ring 302. This arrangement allows the ink supply tube 6 to be easily disconnected by removing the ink supply tube 6 from the O-ring, for example, at the time of replacing the head 10.

To ensure stable ink emission, bubbles in the common ink flow path 301*a* must be removed. For this purpose, as shown in FIG. 4, a bubble outlet 303 for removing bubbles from the ink is arranged at the outlet of the common ink flow path 301*a*. This bubble outlet 303 is connected with the waste ink container 310 by the ink supply tube 6 through the valve 308. The intermediate tank 306 is connected to the pressure pump 314 through the valve 315.

The pressure pump 314 includes a cylinder pump and tube pump. The pressure pump 314 operates when the valves 315 and valve 308 are open. This procedure generates the pressure for pushing out the bubbles out of the common ink flow path 301*a* together with ink through the bubble outlet 303.

Except when removing bubbles, the valve 308 and valve 315 are kept closed. When removing bubbles, the valve 308 and valve 315 are kept open, and the pressure pump 314 is operated to remove bubbles with ink to the waste ink container 310. It is also possible to reuse the ink discharged into the waste ink container 310.

It is also possible to make such arrangements that ink is discharged from the common ink flow path 301*a* through the aforementioned bubble outlet 303.

Figure 5:
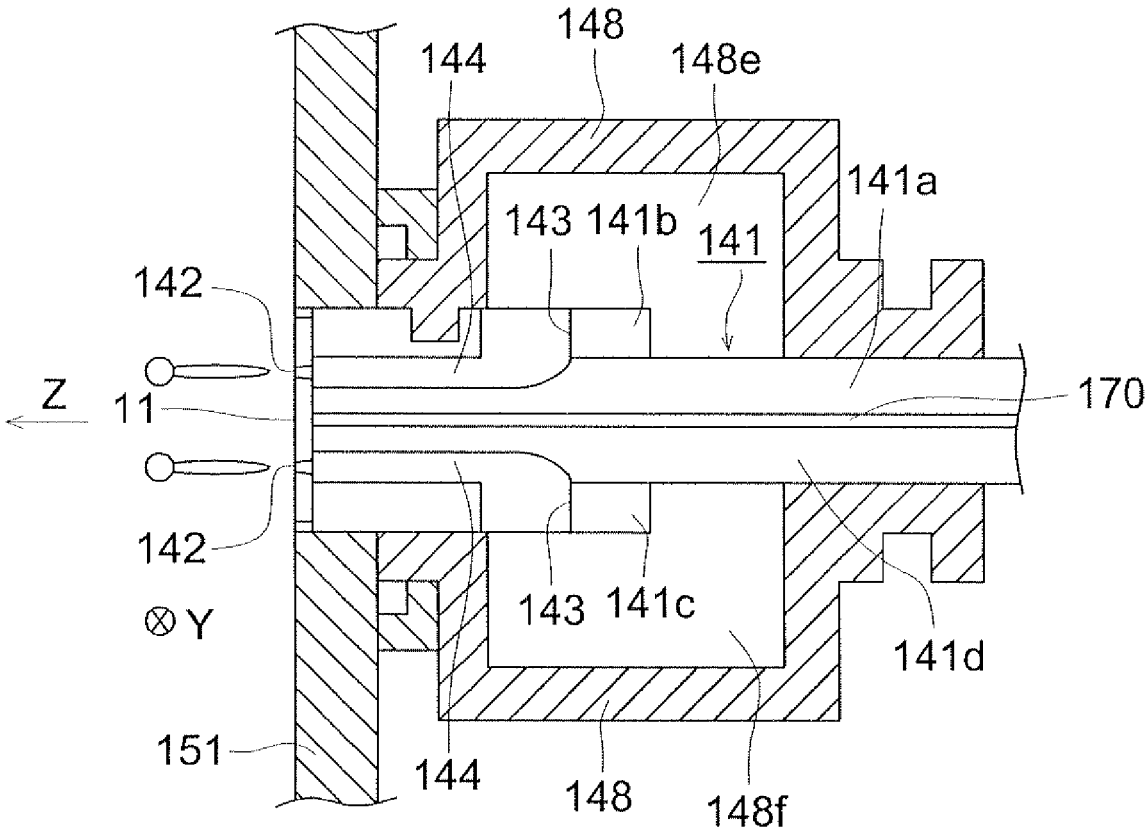
FIG. 5 is a side elevation view in cross section at the nozzle position showing the approximate structure of the head 10 constituting the line head 2.
Figure 6:
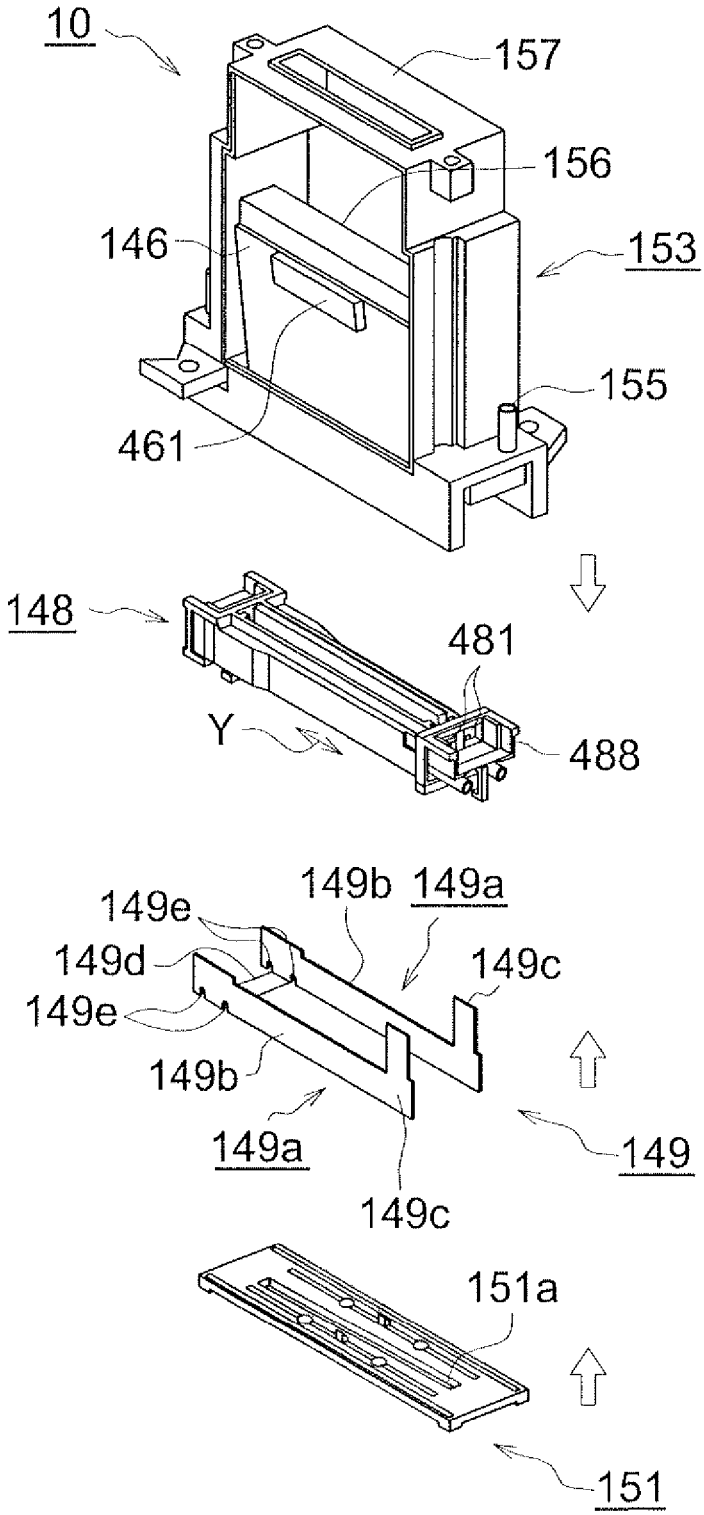
FIG. 6 is an exploded perspective view of the head 10 constituting the line head 2.

The following describes the head 10 with reference to FIGS. 5 and 6: FIG. 5 is a side elevation view in cross section at the nozzle position showing the approximate structure of the head 10. FIG. 6 is an exploded perspective view of the head 10.

As shown in FIG. 5, the head 10 is provided with a head chip 141 for emitting ink in the arrow-marked direction Z through a plurality of nozzles 142 in tow-row staggered arrangement. The arrow marked direction Z is perpendicular to the aforementioned printing medium conveyance direction X.

The head chip 141 includes:

a first ink particle emission substrate made up of a piezoelectric substrate 141*a* wherein a groove as an ink channel 144 is arranged on both surfaces of one substrate 170, and a cover substrate 141*b;* a second ink particle emission substrate made up of a piezoelectric substrate 141*d* provided with a groove as an ink channel 144, and a cover substrate 141*c*. In this case, the aforementioned first ink particle emission substrate and second ink particle emission substrate are bonded to the aforementioned head chip by being displaced P/2 (wherein the nozzle pitch of the ink particle emission substrate is assumed as P). Further, a nozzle plate 11 is bonded thereto, wherein this nozzle plate 11 contains a nozzle 142 arranged at a position corresponding to each ink channel so as to cover all the two ink particle emission substrates and the front end of the substrate 170. The substrate 170 is not always necessary. Two ink particle emission substrates can be bonded directly.

The head chip 141 of the present Example includes two ink particle emission substrates with a plurality of pressure generation devices arranged thereon, and these ink particle emission substrates are boned to each other, and a common nozzle plate 11 is bonded on the front end. This structure ensures compact configuration.

The head chip 141 of the present Example is structured in such a way that the two ink particle emission substrates with a plurality of pressure generation devices arranged thereon are bonded to each other, and a common nozzle plate 11 is bonded to the front end surface thereof. This eliminates the need of positioning the nozzle surface for each head, and installing by positioning one by one, as in the conventional method. This arrangement provides a high degree of assembling workability and productivity.

Further, the head chip 141 is structured in such a way that the two ink particle emission substrates are bonded to each other. This structure facilitates the work of pulling out the electrode when forming an electrode for applying voltage to the drive electrode arranged on the pressure generation device by pulling it to the outside of the head chip. To be more specific, if three or more ink particle emission substrates are bonded, the aforementioned electrode cannot be easily pulled out.

The ink particle emission substrate is manufactured as follows: Grooves as multiple ink channel 144 are formed on the piezoelectric substrates 141*a* and 141*d* made of lead zirconate titanate (PZT) in parallel in the Y direction. Then the grooves are closed by the cover substrates 141*b* and 141*c*, whereby the side wall made of the piezoelectric element (present on the furthest side and the nearest side of sheet surface with reference to the ink channel 144 in FIG. 5) and the sleeve-like ink channel 144 are arranged alternately. The piezoelectric element constituting the side wall is a shear mode piezoelectric element which is subjected to shear deformation by application of the electric field to the drive electrode formed on the surface of the side wall, and corresponds to the pressure generation device in the present Example.

A piezoelectric element other than the shear mode element, and a thermal type element are used as the pressure generation device. Particularly, use of the piezoelectric element is preferred. The shear mode piezoelectric element is used with special preference.

When a piezoelectric element is adopted, it is difficult to reduce the ink channel pitch, i.e. the nozzle pitch. In this case, excellent effects can be obtained by a combination with the present Example.

In the case of the shear mode piezoelectric element, the inkjet head is produced using the channel substrate wherein the partition walls formed of the piezoelectric material such as lead zirconate titanate (PZT) and the ink channels formed in a concave form are mounted alternately. However, there is a limit to the size of the piezoelectric substrate that can be obtained. There is also a limit to the number of the ink channels that can be provided. It is difficult to produce a long type containing a great number of nozzles. In the present Example, a plurality of independent head modules are produced and are alternately displaced in staggered arrangement, whereby the number of ink channels provided side by side is increased and a long inkjet head is formed. This procedure permits easier production of a line head.

Each ink channel 144 is machined in a linear slender groove extending from the front end of the ink particle emission substrate (the left end in FIG. 5) to the rear end (the right end in FIG. 5). The piezoelectric material having been left unmachined is used as a side wall for each ink channel 144. Each ink channel 144 forms a shallow groove which is provided in a concave form from the front end of the ink particle emission substrate to a mid-position of the rear end, wherein the depth of the groove is gradually reduced toward the rear end to disappear at the rear end.

As shown in FIG. 5, the head 10 of the present Example contains an ink inlet 143 on both sides of the head chip 141, wherein ink inlet 143 is provided on the cover substrate 141*b* and 141*c*. The ink inlet 143 and nozzle 142 communicate with each other through the ink channel 144 arranged inside the head chip 141.

A manifold 148 is bonded and fixed on each side of the head chip 141 to lead the ink from the outside to the head chip 141.

The manifold 148 incorporates the ink flow paths 148*e* and 148*f* communicating with the ink inlet 143.

As shown in FIG. 6, an ink inlet 481 for leading ink to the ink flow paths 148*e* and 148*f* is formed on one end of the manifold 148. This ink inlet 481 also serves as an inlet for supplying rinsing liquid when cleaning the inside during the manufacturing process. In the present Example, two ink inlets 481, 481 are formed on each end of the manifold 148. One inlet can be formed, or three or more inlets can be formed.

The ink inlet 481 is provided with a succession of ink receiving sections 488. The ink receiving sections 488 store ink and send it to the ink inlets 481 at the same time.

Both ends of the manifold 148 are provided with an ink heater 149 for heating the internal ink of the manifold 148 to a predetermined temperature through the manifold 148. The aforementioned FIG. 5 shows an ink heater 149.

The ink heater 149 includes the heating sections 149*a*, 149*a* electrically connected with each other by a connection section 149*d*. The heating section 149*a* and connection section 149*d* are composed of the heating wires (not illustrated) connected in a wave form on a flexible film (not illustrated).

To be more specific, the two heating sections 149*a*, 149*a* are arranged approximately in the form of a letter L by the manifold heating section 149*b* engaging with the side of the manifold 148 and the frame heating section 149*c* engaged with the side of the enclosure frame (enclosure) 153 to be described later.

In this case, the manifold 148 is often made of a resin, and the enclosure frame 153 is often made of metal. Thus, much of the heater generated from the ink heater 149 is normally transmitted to the enclosure frame 153.

The heater surface of the two manifold heating sections 149*b*, 149*b* is parallel with the row of nozzles 142 so as to heat the ink supplied to the nozzles 142 in each row.

The frame heating section 149*c* heats the internal ink of the enclosure frame 153 through the enclosure frame 153. It is designed to pre-heat the ink supplied to the manifold 148. It is also possible to make such arrangements that the frame heating section 149*c* is engaged with the inner surface of the enclosure frame 153.

In this case, the aforementioned heating wires of the two heating sections 149*a*, 149*a* may be connected in one and the same pattern, or in different patterns.

A notch 149*e* is provided on the component for connection with the connection section 149*d* in the two heating sections 149*a*, 149*a*. This notch 149*e* is designed to increase the scope of movement of the heating section 149*a* with respect to the connection section 149*d*. The notch 149*e* disperses the force applied to the connection portion between the heating section 149*a* and connection section 149*d*, even when there is a change in the shape of the ink heater 149. This arrangement prevents a break from occurring to the connection portion, and facilitates the work of installing the ink heater 149 to the manifold 148.

To ensure uniform thermal connection with the ink heater 149 and manifold 148 within the heater surface, a predetermined member may be arranged between the ink heater 149 and manifold 148, or an adhesive may be used for filling. Further, the ink heater 149 can be provided in contact with the manifold 148, or away from the manifold 148. The heating sections 149*a* and 149*d* need not be connected with each other. They may be separated and are heated separately.

A temperature sensor (not illustrated) for detecting the temperature may be arranged between the ink heater 149 and head chip 141.

A retaining plate 151 for holding the manifold 148 and head chip 141 is arranged on the lower portion of the head chip 141.

The retaining plate 151 is provided with an opening 151*a*, and the emission side is exposed.

Further, two head driving boards 146, 146 are connected on the upper portion of the head chip 141 through a flexible wiring board (not illustrated), wherein the head driving boards 146, 146 apply the drive voltage to the drive electrode formed on the surface of the partition wall made up of the piezoelectric element in response to the control signal from the ICB substrate 500.

Each head driving board 146 is provided with a connector 461. The connector 461 is electrically connected with the aforementioned ICB substrate 500 so that the control signal and electric power are supplied to the head driving board 146.

The heater circuit is formed on the ICB substrate 500 to supply electric power to the ink heater 149. The aforementioned heating wire of the ink heater 149 electrically connected to this heater circuit through the head driving board 146. The aforementioned temperature sensor is also electrically connected to the heater circuit through the head driving board 146.

The aforementioned head chip 141, manifold 148, head driving board 146 and retaining plate 151 are secured to the enclosure frame 153. To be more specific, an adhesive is filled between the enclosure frame 153 and manifold 148 in such a way as to include at least the ink heater 149. This adhesive controls heat transmission from the ink heater 149 to the enclosure frame 153.

The enclosure frame 153 is provided with a frame ink flow path (ink flow path) 155 for supplying ink to the ink receiving section 488. This frame ink flow path 155 is connected with the ink supply tube 6 leading from the common ink flow path 301*a*. A support beam 156 for supporting two head driving boards 146, 146 is arranged inside the enclosure frame 153.

An opening 157 is arranged on the upper portion of the enclosure frame 153. The ICB substrate 500 is connected with the head driving board 146 through this opening 157 after the head 10 has been assembled.

The following describes the procedure of manufacturing the head 10.

A head chip 141 is produced according to the aforementioned procedure.

The manifold 148 is bonded on each side of the head chip 141.

The head driving boards 146, 146 are connected to the upper portion of the head chip 141 through the aforementioned flexible wiring board. The ink heater 149 is mounted on the surface of the manifold 148. In this case, there is no need of supplying electric power to each heating section 149*a* since the heating sections 149*a*, 149*a* are connected along the surface of the manifold by the connection section 149*d*.

A retaining plate 151 is mounted on each of the lower portions of the head chip 141 and manifold 148.

The integrally formed head chip 141, manifold 148, ink heater 149, retaining plate 51, the aforementioned flexible wiring board and head driving boards 146, 146 are mounted on the enclosure frame 153, whereby manufacture of the head 10 terminates.

The aforementioned ICB substrate 500 is electrically connected to the connectors 461, 461 arranged on the head driving boards 146, 146.

Because ink can be heated by the heating section 149*a* and connection section 149*d*, manifold the internal ink can be kept at a uniform temperature.

The aforementioned embodiment has been described as containing two heating sections 149*a*. Three or more two heating sections 149*a* may be included if the connection section 149*d* is used for connection.

In the example shown in FIG. 6, the ink heater 149 is provided in contact with the manifold 148. The aforementioned ink heater 149 can be arranged as it is separated from the manifold 148.

The aforementioned ink heater 149 can be installed on each of the two sides of the manifold 148 or on either side.

The inkjet head may be supplied with such an ink as the ultraviolet curable ink which has a high viscosity at the normal temperature, wherein this viscosity is reduced with the rise in temperature. However, in the present Example, a heater 149 is provided to heat the ink and to reduce the viscosity before the ink is emitted from the head 10. This arrangement ensures stable ink emission.

In the line head 2 of the present Example, ink is supplied to the head 10 through the common ink flow path 301*a*. If the ink temperature inside the common ink flow path 301*a* (depending on the ambient temperature) is too low, ink cannot be heated sufficiently in the ink heater 149 in some cases. Accordingly, the enclosure frame 153 and common support substrate 20 as well as the common ink flow path forming member 301 provided integrally therewith are preferably made up of the material having an excellent thermal conductivity of 10 W/m·K or more such as a metal such as aluminum. The products made of aluminum molded by diecasting are preferably used.

According to the aforementioned structure, the heat generated by the ink heater 149 is transferred from the enclosure frame 153 to the common ink flow path forming member 301 through the common support substrate 20. Thus, the ink can be heated in advance in the common ink flow path 301*a*, with the result that heating efficiency can be improved.

When ink is to be supplied to the long common ink flow path 301*a* from the ink inlet 304 on one side as in the present Example, and high-viscosity ink is used, loss of pressure resulting from the resistance in the flow path occurs inside the supply path (inside the common ink flow path 301*a*) due to high viscosity. This makes it difficult to ensure a stable supply of the high-viscosity ink from the intermediate tank to the head, and stable emission of ink from the head may not be ensured in some cases. When the viscosity is reduced by preliminary heating in the common ink flow path 301*a*, more stable ink supply is ensured.

When a low-viscosity ink such as a normal water based ink is to be emitted from the head 10, ink emission must be performed at a room temperature without providing or operating the ink heater 149. Accordingly, the enclosure frame 153 and common support substrate 20 are preferably made of a material of good thermal conductivity, i.e. the material having a thermal conductivity of 10 W/m·K or more, as exemplified by aluminum and other metals. Particularly the aluminum molded by diecasting is preferably used. Conversely, the common ink flow path forming member 301 is preferably made of a material with a poor thermal conductivity of 1 W/m·K or less as exemplified by a resin.

When this arrangement is adopted, the heat generated from the pressure generation device and circuit substrate can be transmitted to the common support substrate 20 through the enclosure frame 153, and can be released. Further, this arrangement preferably ensures that this heat is not transmitted to the common ink flow path forming member 301 and ink is not heated in the common ink flow path 301*a*.

FIG. 7 (*a*) is a drawing representing the line head 2 as viewed from the nozzle 142. FIGS. 7 (*b*) and 7 (*c*) are enlarged views showing the circled portion A of FIG. 7 (*a*).

As described above, the line head 2 includes a staggered arrangement of a plurality of head modules 100. Each of these head modules 100 is provided with a plurality of nozzles 142.

As described above, each of the two heads 10 constituting the head module 100 has two row of nozzles displaced by P/2 in staggered arrangement. As shown in FIGS. 7(*b*) and (*c*), four rows of the nozzles (each row corresponding to the rows of the nozzles of the ink particle emission substrate) of the two heads 10 are arranged in such a way that each row of nozzles is positioned in the Y direction as displayed one fourth of the nozzle pitch P of the ink particle emission substrate. Further, the head module 100 (phase between nozzles) has a nozzle pitch of P/4, whereby high-definition is provided. Since the P/4 is very small, the nozzle 142 is shown in FIG. 7 (*a*) as not being displaced in appearance.

As described above, in the line head 2 of the present Example and the line type inkjet printer 1 equipped with the same, the head modules 100 each having a plurality of line heads 2 are installed in a staggered arrangement. In each of two heads constituting the aforementioned head module 100, two ink particle emission substrates wherein a plurality of pressure generation devices are arranged are bonded to each other. This head module is a combination of n-heads 10 (wherein "n" indicates an integer of two or more) each provided with the head chip 141 containing a common nozzle plate 11. The structure is so designed that the nozzle pitch of the aforementioned head module 100 is 1/(2n) of the nozzle pitch of the ink particle emission substrate. This structure provides a line head and line type inkjet printer provided with the same, wherein the line head is capable of high-definition printing in one scanning operation and is characterized by compact configuration and excellent productivity. This structure also provides a line head and line type inkjet printer provided with the same, wherein the line head is capable of high-definition printing in one scanning operation and is characterized by easy positioning among a plurality of heads 10.

As shown in FIG. 7 (*b*), each head module 100 installed in a staggered arrangement is positioned in such a way that the centerline of the nozzle 142 on the rightmost end of the head module 100 on the upper side of the figure is apart from the nozzle 142 on the leftmost end of the head module on the lower side of the figure by a nozzle pitch of P/4. In the similar manner, the rows of nozzles of each head modules 100 on the upper and lower portions of the figure are arranged with the common ink flow path 301*a* sandwiched in-between.

This structure allows the nozzle rows of the entire line head 2 to be arranged at the same nozzle pitch of P/4 along the length of the aforementioned line head 2. As shown in FIG. 7 (*c*), it is also possible to make such arrangements that one or more nozzles 142 (four nozzles 142 are overlapped in FIG. 7) at the end of each of the head modules 100 on the upper and lower portions of the figure overlap each other, with the common ink flow path 301*a* sandwiched in-between. In this case, this arrangement ensures easy adjustment of the phase of the nozzles 142 among head modules 100. For the overlapped portion, it is also possible to arrange such a configuration that one of the nozzles is used for normal ink emission and the other is used as a replacement when emission failure has occurred. Further, for the overlapped portion, ink particles are emitted from the nozzles 142 alternately for each line or for several lines, so that large and small ink particles are emitted alternately in the direction of conveying the printing medium, even if there is a difference in the size of the ink particles emitted from the nozzle 142 of the end between the head modules 100. This prevents a white stripe from occurring to the connection between the head modules 100.

This processing is preferably performed by the aforementioned relay substrate 600.

For the line head 2 wherein the head modules 100 each having a plurality of heads 10 is mounted in a staggered arrangement, each head 10 is preferably arranged in such a way that the position in the Y-direction (along the arrangement of the nozzles) and the angle θ in the X-direction (along the conveyance of the printing medium) can be adjusted independently. For the position in the X-direction, ink is emitted to a desired position by electrical means wherein the information on the position of each head 10 is obtained according to a known method and the ink emission timing is adjusted according to the information on the deviation of time corresponding to the space between heads.

Referring to FIGS. 8 through 12, the following describes the head (nozzle) position adjusting mechanism provided on each head 10.

The head position adjusting mechanism is common to all the heads.

Figure 8:
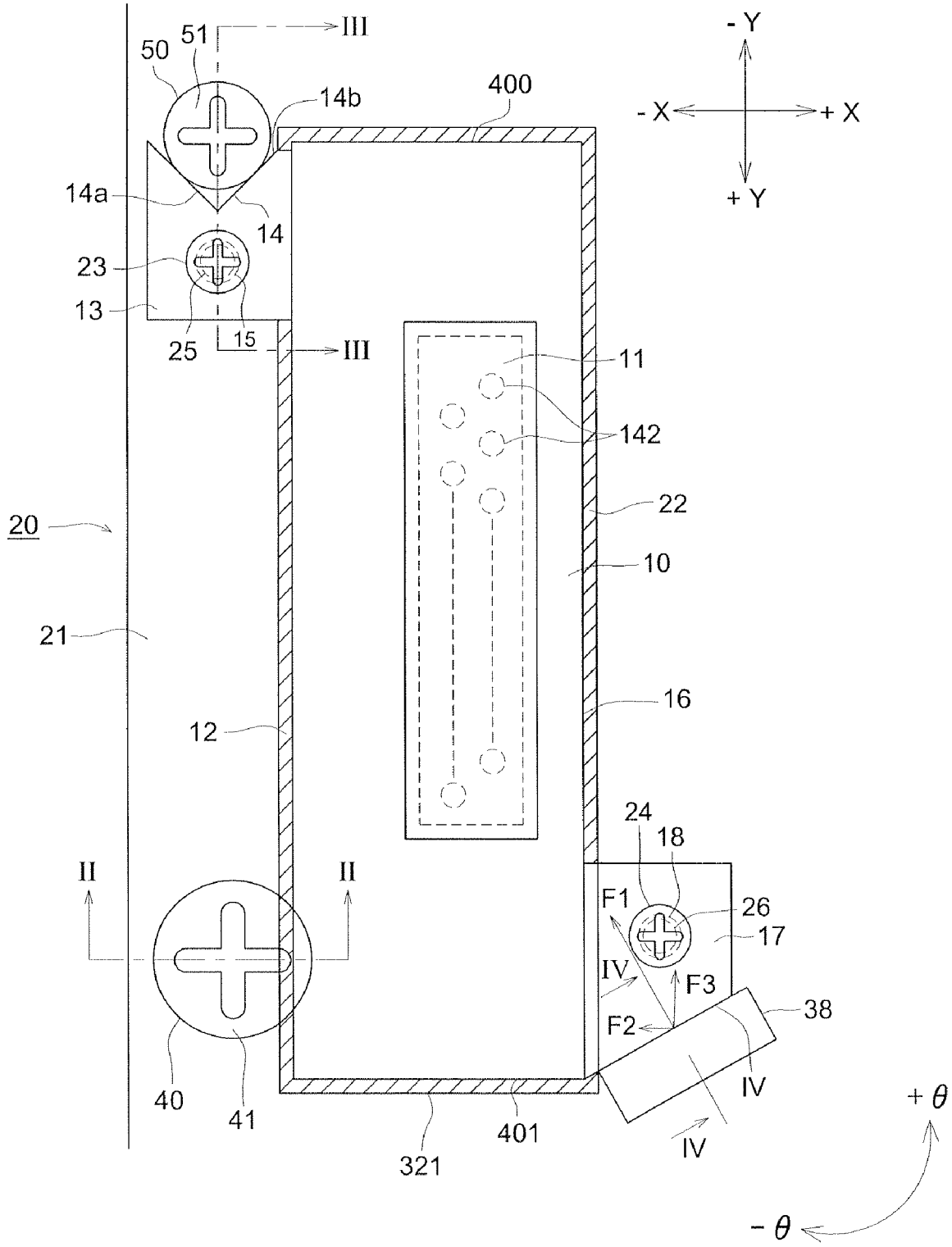
FIG. 8 is a plan view of the head 10 constituting the line head 2 and the periphery thereof.
Figure 9:
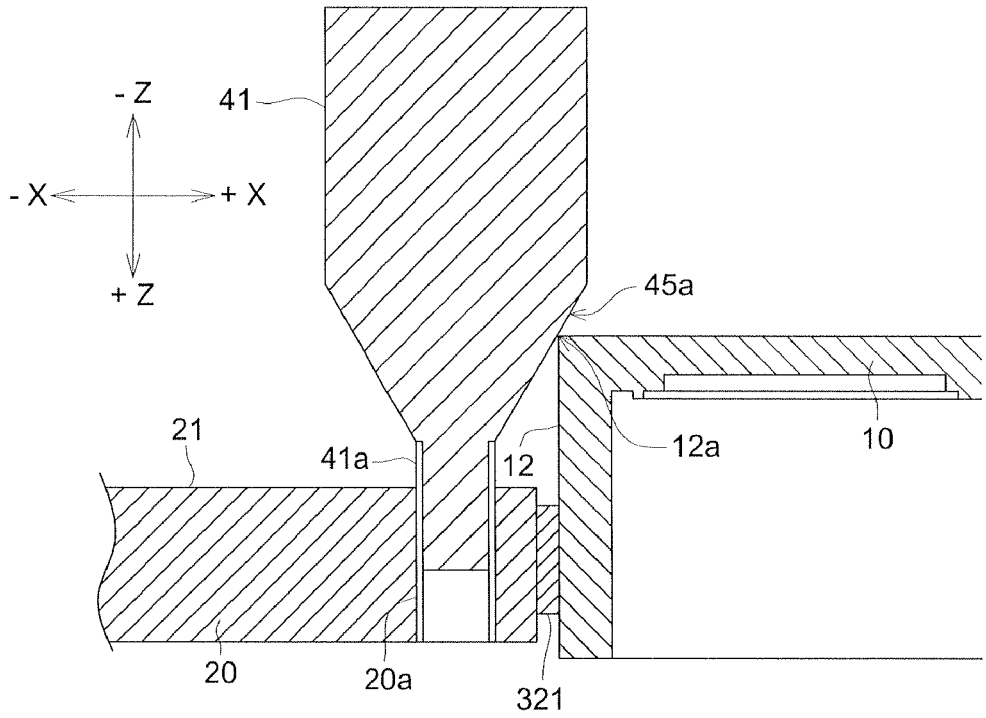
FIG. 9 is a cross sectional view taken along the surface II-II of FIG. 8.
Figure 10:
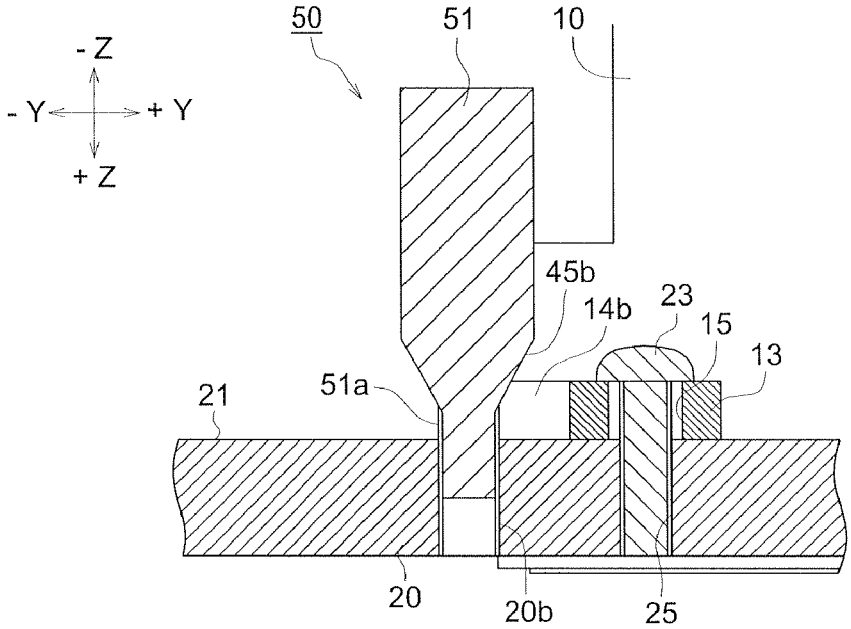
FIG. 10 is a cross sectional view taken along the surface III-III of FIG. 8.
Figure 11:
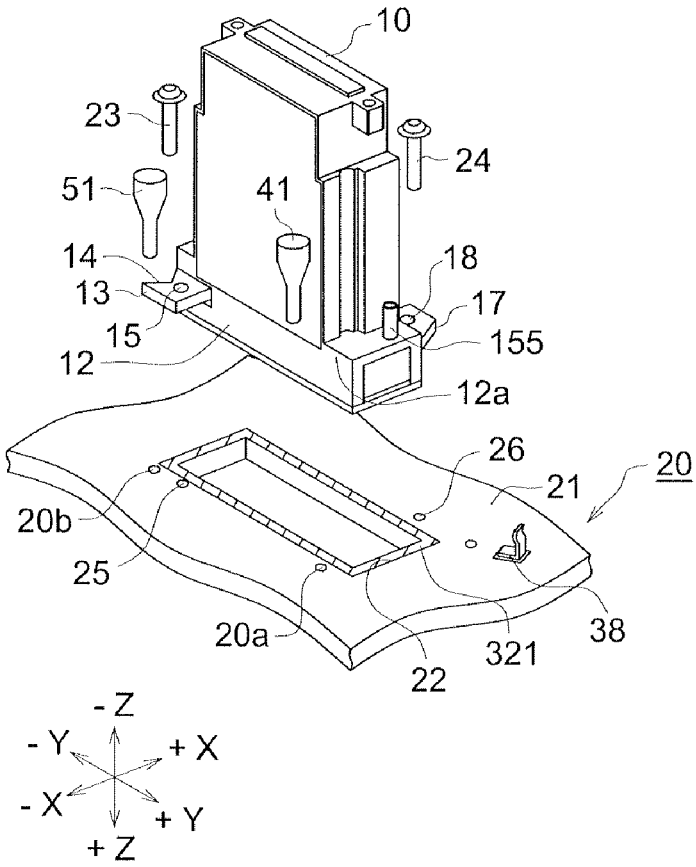
FIG. 11 is a perspective view of the head 10 and common support substrate 20.
Figure 12:
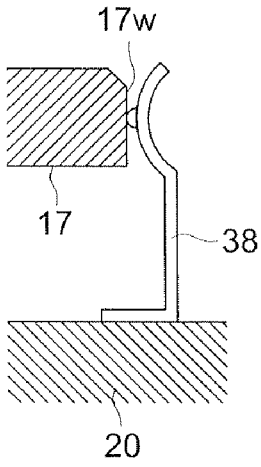
FIG. 12 is a cross sectional view taken along the surface IV-IV of FIG. 8.

FIG. 8 is a plan view of the head 10 and its surrounding. FIG. 9 is a cross sectional view taken along the surface II-II of FIG. 8. FIG. 10 is an enlarged view showing the cross section taken along the surface III-III of FIG. 8. FIG. 11 is a perspective view showing part of the head 10 and common support substrate 20. FIG. 12 is an enlarged view showing the cross section taken along the surface IV-IV of FIG. 8.

As described above, the line head 2 is provided with a common support substrate 20 as a head mounting section for mounting a plurality of head 10. One side 21 of the common support substrate 20 serves as the mounting surface for mounting the head 10. A plurality of rectangular mounting holes 22 (in the number corresponding to the number of heads; 12 holes in the present Example) are arranged on the mounting surface 21 of the common support substrate 20. The mounting hole 22 is provided with the head 10 containing a gap (play). To fill this gap, a sponge-like sheet 321 as an elastic member is bonded inside the mounting hole 22 (inner peripheral surface). The figure shows one mounting hole 22 and one head 10.

The direction of the normal line of the mounting surface 21 of the common support substrate 20 (direction of the mounting surface 21 of the common support substrate 20) is defined as −Z direction and the direction opposite to the −Z direction is defined as +Z direction. One of the longitudinal directions of the mounting hole 22 is defined as +Y direction and the direction opposite to the +Y direction is defined as −Y direction. The negative direction perpendicular to the +Y and +Z directions is defined as the +X direction, and the other direction perpendicular to the +Y and +Z directions is defined as the −X direction. When the X, Y and Z directions are defined as described above, the direction in which the printing medium is conveyed is the +X direction and the opposite direction in which the printing medium is conveyed is the −X direction. The direction in which the nozzle 142 is arranged is the Y direction.

In the head 10, the length in the +Y direction and the height along the +Z direction are greater than the width along the +X direction. The nozzle plate 11 on the lower surface of the head 10 is provided with two rows of nozzles 142 which are arranged in the +Y direction. The head 10 is designed to emit ink through these nozzles 142. The side 12 facing the −X direction of the head 10 is provided on the head 10 as the outer surface of the head 10. When the head 10 is mounted in the mounting hole 22, the side 12 of the head 10 is located perpendicular to the mounting surface 21 of the common support substrate 20, and is parallel to the +Z direction and ±Y direction. Further, it is orthogonal to the ±X direction.

The following describes the structure of fixing the head 10 onto the common support substrate 20:

In the side 12 of the head 10, a plate-formed stationary section 13 parallel to the mounting surface 21 of the common support substrate 20 is mounted integrally with the head 10 on the rectangular portion in the +Z direction and −Y direction. When the stationary section 13 is viewed in the +Z direction, a V-shaped notch 14 is formed on the side edge of the stationary section 13 in the −Y direction. Both side ends 14*a* and 14*b* of the notch 14 are provided on the head 10 as the outer surfaces of the head 10. The surfaces 14*a* and 14*b* on both sides of the notch 14 are orthogonal to the mounting surface 21 of the common support substrate 20.

A hole 15 penetrating in the ±Z direction is formed on the stationary section 13, and a screw 23 is inserted in this hole 15. This screw 23 is engaged with the screw hole 25 formed on the mounting surface 21 of the common support substrate 20. The diameter of the hole 15 is smaller than that of the screw 23, and is greater than the shaft of the screw 23 (threaded portion). Thus, if the screw 23 is loosened, the head 10 can be moved along the XY plane over the distance corresponding to the play between the shaft of the screw 23 and the hole 15, even when the screw 23 is engaged with the screw hole 25 of the common support substrate 20. On the other hand, if the screw 23 is tightened, a stationary section 13 is sandwiched between the head of the screw 23 and the mounting surface 21 of the common support substrate 20, with the result that the head 10 is secured to the common support substrate 20.

In the side 16 opposite to the side 12, a plate-formed stationary section 17 parallel to the mounting surface 21 of the common support substrate 20 is provided integrally with the head 10 on the rectangular portion in the +Z direction and +Y direction. This stationary section 17 is also provided with a hole 18 penetrating in the ±Z direction. A screw 24 is inserted in the hole 18, and the screw 24 is engaged with the screw hole 26 formed on the mounting surface 21 of the common support substrate 20. The diameter of the head of the screw 24 is greater than that of the hole 18, and the diameter of the shaft of the screw 24 is smaller than that of the hole 18. Play is provided between the shaft of the screw 24 and hole 18. The stationary section 17 is equipped with a spring shoe 17W. When the spring shoe 17W is engaged with the plate spring 38 secured to the common support substrate 20, the head 10 is positioned in the XY direction. This engagement is given when the head 10 is energized with respect to each of the inclined surfaces 45*a* and 45*b* of the threaded spindles 41 and 51 to be described later, with the force component F2 (component of force in −X direction) of the load F1 wherein the plate spring 38 presses against the spring shoe 17W and F3 (component of force in −Y direction).

The following describes the θ direction position adjusting structure 40 in the Example to which the head position adjusting structure of the present Example is applied. This θ direction position adjusting structure 40 adjusts the angle of the head 10 in the ±θ direction and the angle of the nozzle row by turning the head 10 in the ±0 direction.

The θ direction position adjusting structure 40 is parallel to the side 12 of the head 10 and is upright with respect to the mounting surface 21 of the common support substrate 20. It is made up of a threaded spindle 41 mounted on the mounting surface 21.

The threaded spindle 41 has a screw thread 41*a* as a male screw. It is engaged with the female screw 20*a* arranged on the common support substrate 20 further in the −X direction than the position of the head 10, and is supported rotatably. This threaded spindle 41 is provided perpendicular to the mounting surface 21 of the common support substrate 20, and the centerline of the threaded spindle 41 is parallel to the ±Z direction. An inclined surface 45*a* is formed on the outer periphery of the threaded spindle 41.

This inclined surface 45*a* is kept in a point contact with the rectangular portion 12*a* of the side 12 of the head 10.

The normal line of the inclined surface 45*a* is inclined with respect to that of the side 12 of the head 10, and the inclined surface 45*a* is inclined with respect to the side 12 of the head 10. Further, the inclined surface 45*a* is formed inclined with respect to the mounting surface 21 of the common support substrate 20, and is inclined in the ±Z direction (in the centerline direction of the threaded spindle 41). This inclined surface 45*a* is formed in such a way that the distance to the centerline of the threaded spindle 41 is reduced, as one goes closer to the mounting surface 21 of the common support substrate 20, and the distance to the centerline of the threaded spindle 41 is increased, as one goes away from the mounting surface 21 of the common support substrate 20.

In the present Example, the stationary section 13 is arranged to the side 12 of the head 10 and the stationary section 17 is on the side 16 as the opposite side. However, in the present Example, there is no restriction to the position where the stationary section is provided. For example, it is also possible to arrange such a configuration in FIG. 8 that the stationary section 13 is mounted on either of the end faces 400 and 401 of the head opposed to Y-axis direction, while the stationary section 17 is mounted on the other. This arrangement preferably allows the substantial thickness of the head 10 in the X direction, and hence reduces the space between a plurality of heads 10 in the module head. Further, in this arrangement, at least some portions of the stationary section 13 and stationary section 17 preferably overlap with each other in the X direction.

The following describes the Y-direction position adjusting structure 50 to which the head position adjusting structure of the present Example is applied: This Y-direction position adjusting structure 50 moves the head 10 in the ±Y direction, thereby adjusting the position of the head 10 in the ±Y direction and the row of the nozzles.

The Y-direction position adjusting structure 50 is parallel to the surfaces 14*a* and 14*b* of the head 10 and is upright with respect to the mounting surface 21 of the common support substrate 20. It is composed of a threaded spindle 51 provided on the mounting surface 21.

The threaded spindle 51 has a screw thread 51*a* as a male screw. It is engaged with the female screw 20*b* arranged on the common support substrate 20 further in the −Y direction than the surfaces 14*a* and 14*b* of the head 10, and is rotatably supported. This threaded spindle 51 is arranged perpendicular to the mounting surface 21 of the common support substrate 20, and the centerline of the threaded spindle 51 is parallel to the ±Z direction. An inclined surface 45*b* is formed on the outer periphery of the threaded spindle 51.

This inclined surface 45*b* is kept in point contact with the rectangular portion on the −Z side of the surfaces 14*a* and 14*b* of the head 10.

The inclined surface 45*b* is formed inclined with respect to the mounting surface 21 of the common support substrate 20, and is inclined in the ±Z direction (in the centerline direction of the threaded spindle 51). The inclined surface 45*b* is inclined in such a way that the distance to the centerline of the threaded spindle 51 is reduced, as one goes closer to the mounting surface 21 of the common support substrate 20, and the distance to the centerline of the threaded spindle 51 is increased as one goes away from the mounting surface 21 of the common support substrate 20. The inclined surface 45*b* is formed in such a way that the normal line is inclined with respect to the normal line of the surface 14*a* and the normal line of the surface 14*b* of the head 10. The inclined surface 45*b* is inclined with respect to the surfaces 14*a* and 14*b* of the head 10.

The following describes the procedure of positioning the head 10 using the θ direction position adjusting structure 40 and Y-direction position adjusting structure 50:

When the user loosens the screws 23 and 24, the head 10 can be moved with respect to the common support substrate 20.

When the user turns the threaded spindle 41 to move the threaded spindle 41 closer to the mounting surface 21 of the common support substrate 20, the head 10 is pushed by the inclined surface 45*a* and is moved in the +θ direction with the threaded spindle 51 as an axis.

If the user turns the threaded spindle 41 in the reverse direction to move the threaded spindle 41 away from the mounting surface 21 of the common support substrate 20, the head 10 is pushed by the energizing force F2 of the plate spring 38, and can be moved in the −θ direction with the threaded spindle 51 as an axis. Then the head 10 is moved in the −θ direction.

As described above, the user turns the threaded spindle 41, whereby the head 10 is positioned in the ±θ direction. The θ is set in such a way that the +Y direction as the direction of the row of nozzles will form an angle of 90 degrees with respect to the +X direction, which is the traveling direction of the printing medium.

Then the user turns the threaded spindle 51 in one direction to move the threaded spindle 51 closer to the mounting surface 21 of the common support substrate 20. The head 10 is pushed by the inclined surface 45*b* and is moved in the +Y direction.

If the user turns the threaded spindle 51 in the reverse direction to move the threaded spindle 51 away from the mounting surface 21 of the common support substrate 20, the head 10 can be moved in the −Y direction by the energizing force F3 of the plate spring 38. Then the head 10 is moved in the −Y direction.

As described above, the head 10 is positioned in the ±Y direction by the user turning the threaded spindle 51. For the Y-direction positioning, adjustment and positioning should be performed to get the nozzle arrangement as shown in FIG. 7 (*b*) or (*c*), for example.

After the head 10 has been positioned in the ±θ direction and ±Y direction, the user tightens the screws 23 and 24, and fixes the head 10 to the common support substrate 20.

If the threaded spindle 41 is replaced by the threaded spindle having a greater outer diameter, the head 10 can be positioned further in the +θ direction than the head 10 using the threaded spindle 41. If the threaded spindle 41 is replaced by the threaded spindle of smaller outer diameter, the head 10 can be positioned further in the −θ direction than the head 10 using the threaded spindle 41. Similarly, if the threaded spindle 51 is replaced by the threaded spindle having a greater outer diameter, the head 10 can be positioned further in the ±Y direction than the head 10 using the threaded spindle 51.

As described above, in the present Example, each of the heads 10 placed in a staggered arrangement is provided with a head position (nozzle position) adjusting mechanism. This ensures easy adjustment of the position of the head 10.

The inclined surfaces 45*a* and 45*b* are provided on the threaded spindle, not on the head 10. This eliminates the need of high precision designing of the head 10. The threaded spindles 41 and 51, which are not replacement parts, are provided with inclined surfaces 45*a* and 45*b*. This eliminates the need of checking the dimensional error at every replacement of the head 10 if the dimensional error of the inclined surfaces 45*a* and 45*b* has been checked once.

The threaded spindles 41 and 51 are provided in a cylindrical form. This structure ensures that the inclined surface 45*a* is kept in contact with the rectangular portion 12*a* of the side 12 of the head 10, even if the threaded spindle 41 rotates about the centerline. Even if the threaded spindle 51 rotates around the centerline, the inclined surface 45*b* is kept in contact with the rectangular portion of the surfaces 14*a* and 14*b* of the head 10 in the +Z direction.

Without being restricted to the present Example, the head position adjusting mechanism can be improved and re-designed in a great number of variations as required.

Figure 13:
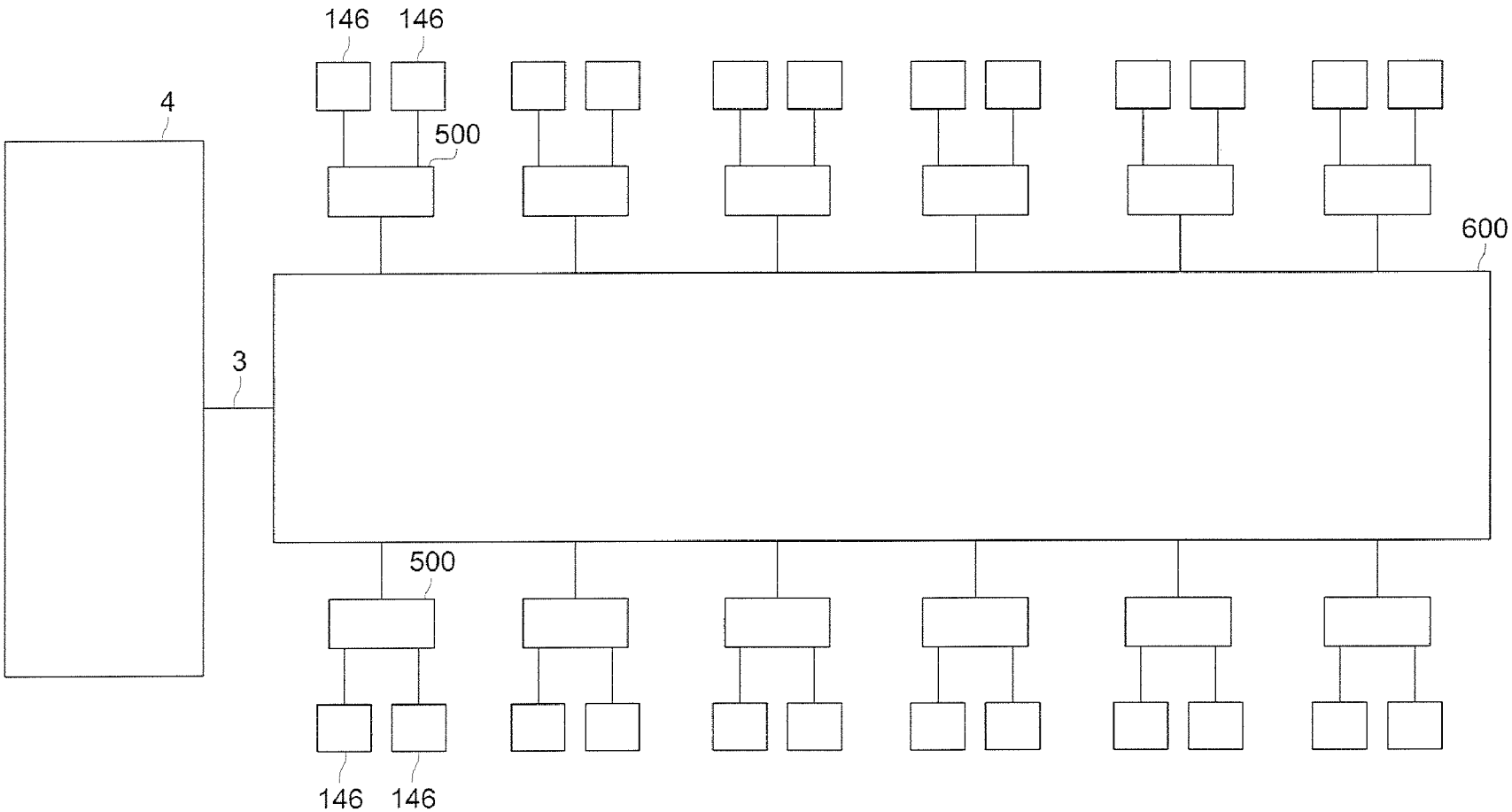
FIG. 13 is a connection diagram showing the electrical wiring among units of the inkjet printer.

The following describes the function and control procedure of the inkjet printer:

FIG. 13 is a connection diagram showing the electrical wiring between the units of the inkjet printer.

The control board 4 as the unit of the main body performs the functions of: generating various control signals; sequentially reading the image data from the image memory storing the image data to be printed by each head 10; generating the power of the amplification circuit for amplifying the drive signal for driving the head driving board 146 of the head 10, and heater power for heating the ink; and transmitting them to the relay substrate 600 through a plurality of flexible cable 3.

The relay substrate 600 distributes the aforementioned signal and power, and transmits them to a plurality of ICB substrate 500 through the flexible cable. The relay substrate 600 is provided perpendicular to the printing medium P, i.e. a common support substrate 20, as shown in FIG. 2. The aforementioned arrangement of the relay substrate 600 ensures that the substrate does not interfere with adjustment of head position, and provides a compact configuration of the apparatus and reduced cable length.

The ICB substrate 500 is provided with a drive signal generating circuit. It receives the signal and power generated by the control board 4 through the relay substrate 600, converts the signal into the form conforming to the head 10, and sends it through a flexible cable to the head driving board 146 arranged on the head 10. The head driving board 146 receives the signal converted by the ICB substrate 500, and drives the head chip 141 so that the image data is printed on the printing medium P.

Figure 14:
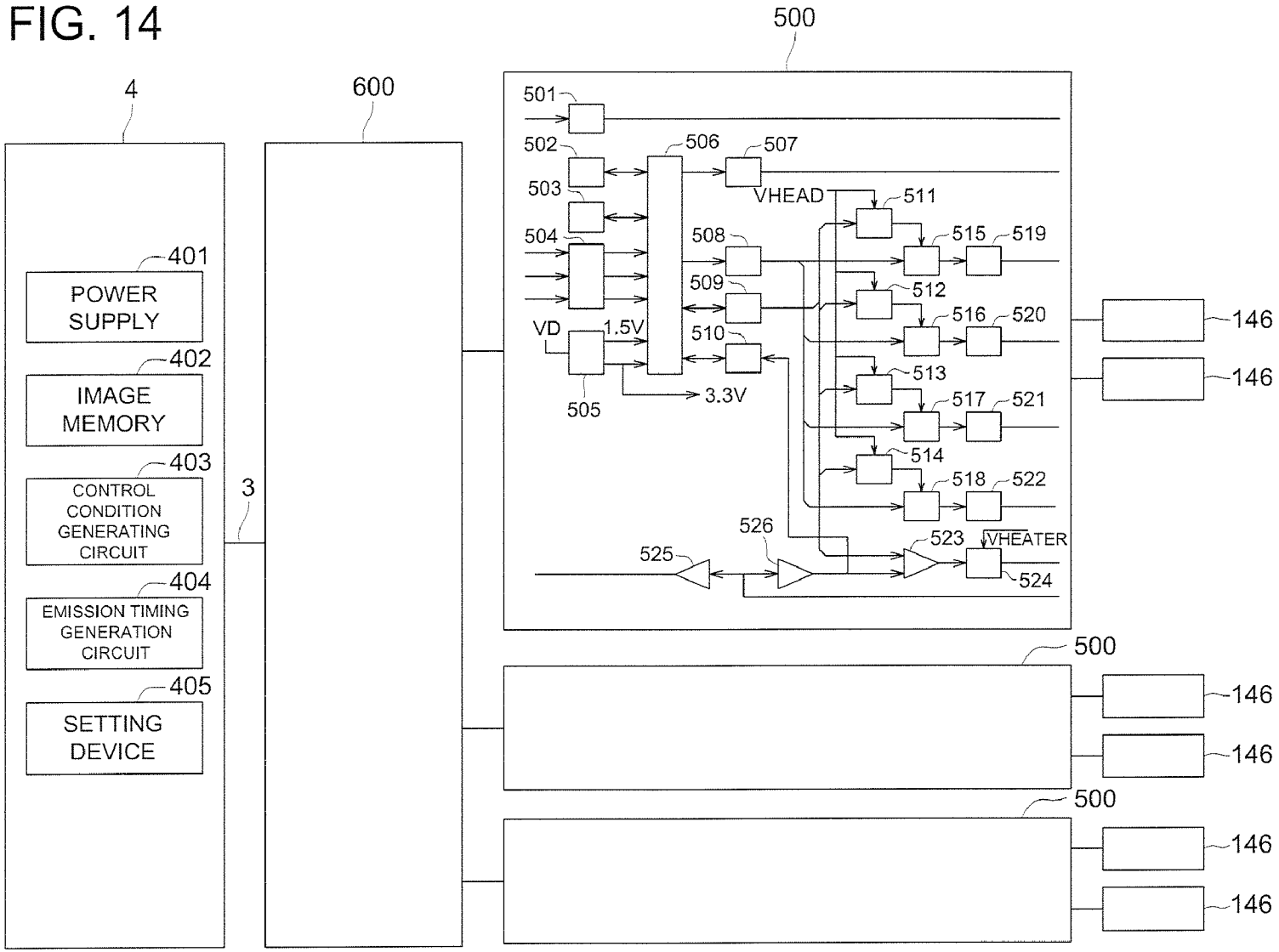
FIG. 14 is an electrical block diagram of an inkjet printer.

FIG. 14 is an electrical block diagram of an inkjet printer.

As described with reference to FIG. 13, the control board 4, relay substrate 600, ICB substrate 500 and head driving board 146 as units of the main body are connected through a flexible cable. In FIG. 14, only three units are shown for the ICB substrate 500, without the present invention being restricted thereto.

Referring to FIG. 14, the following describes the substrate functions:

1. Control Board 4

[Power Supply]

A power supply circuit 401 is provided to generates the voltages of three types of power supplies—a heater power supply (VHEATER) for heating the ink, an amplification circuit power supply (VHEAD) for amplifying the driven signal for driving the head chip 141, and a logic power supply (VD) for ICB substrate 500 and head driving board 146. The power supply circuit used is preferably designed as a switching regulator type circuit for controlling heat generation.

[Image Data]

The image memory 402 stores image data. The image data is read out when printing an image, and is transferred to each of the heads 10 in parallel. The data has a maximum of 2 bits per pixel, wherein the number of bits is determined by the head structure. The structure of the image memory 402 (number of data bits and memory address assignment) can be changed in conformity to the number of data bits and image size.

The head 10 is made up of two ink particle emission substrates and the image memory is divided into the number twice that of the head 10.

[Control Signal]

The control condition generating circuit 403 generates the drive signal conditions for driving the head 10 (e.g. voltage and pulse width), ink emission time intervals, and ink heating temperature set values (THM shown in the symbol column 802 of FIG. 15). These signals are sent to the ICB substrate 500 through the relay substrate 600. In the ICB substrate 500, these conditions are once stored in the register which is assigned to the nonvolatile memories 502 and 503. Various conditions for ink emission are read from the register and various circuits are operated according to these conditions, whereby control signals are generated. The control board 4 receives the data on the detected ink temperature and the contents of the aforementioned register from the TCB substrate 500. Serial communication method is preferably used for transmission and reception of these control conditions, because the number of wires can be reduced.

[Emission Timing]

The emission timing generation circuit 404 generates the emission timing signal and sends it to the ICB substrate 500 through the relay substrate 600. The emission timing signal triggers emission of the ink particles by the head 10, and is generated every time ink particles are emitted.

[Setting Device]

The setting device 405 changes the structure of the aforementioned image memory 402 according to the type of the head 10 and the structure of the line head inputted from the operation section (not illustrated) or the connected host computer. Further, the control conditions inputted from the operation section or host computer are sent to the control condition generating circuit 403. The control condition generating circuit 403 converts the control conditions into such a form as to permit transfer to the ICB substrate 500, whereby they are sent to the ICB substrate 500. In this way, even if a different head 10 is connected or head operation conditions have been changed, the ICB substrate 500 can generate the control signal conforming to the head 10 and ensures accurate printing to be performed.

2. Relay Substrate 600

The relay substrate 600 is a pattern wired substrate for distributing various signals and power having been sent from the control board 4 to the connected ICB substrate 500, and for transmitting or relaying the ink temperature data and the state on the ICB substrate 500 from the ICB substrate 500 to the control board 4.

Communications between the control board 4 and relay substrate 600 are separated according to the image data signal, power supply, control conditions and emission timing signal, and separate cables are used for transmission and reception. Further, separate cables are preferably used for two bits of the image data.

Connection by separate cables eliminates the need of connecting the cable which is not normally used for transmission and reception of signals. For example, once the control conditions are written into the ICB substrate 500, there is no need for transmission and reception of the control signal, if the type and structure of the head are not changed. For the image data (DATAL0 and DATAL1), only transmission of the DATAL0 is needed when the functions of the multi-graduation printing to be described later are not used. This arrangement saves the time and effort for connecting the cable and reduces the number of cables to be connected, thereby removing the need of complicated work.

3. ICB Substrate 500

The ICB substrate 500 converts various signals for driving the head 10 generated by the control board 4 into the signals conforming to the structure of the head 10. The head 10 is provided with two head driving boards 146, and therefore, the ICB substrate 500 has a circuit for driving two head driving boards 146. The following description is based on the assumption that one head driving board 1 is placed under control, and will be given according to the order of the power and signals sent from the control board 4.

[Power Voltage]

The power voltage includes the voltages of the power supply (VHEATER) of the current amplifier 524 for generating the heater current to heat ink; the power supply (VHEAD) of the drive voltage generating circuits 511 through 514 for determining the voltage of the head drive signal (drive ON signal and drive OFF signal); the IC (hereinafter referred to as "ASIC") power supply (e.g. 1.5 V) made by integration of the logic circuits produced by the DC-DC converter 505 according to the input of the VD and VD as logic voltages; and the power supply (e.g. 3.3 V) for driving the low voltage logic IC.

[Transmission of Image Data]

The image data of one bit (e.g. DATAL0 in FIG. 16) or two bits (e.g. DATAL0 and DATAL1 in FIG. 17) read out from the image memory 402 of the control board 4 is serially transferred to the shift register (701 in FIG. 18) of the head driving board 146. The clock signal (SCLK in FIG. 16) is a clock for transferring the image data to the shift register 701. Further, the latch clock signal (LAT in FIG. 16) latches the image data transferred to the shift register 701, into the parallel register (702 in FIG. 18). The aforementioned three signals—the image data, clock signal (SCLK) and latch clock signal (LAT)—are undergone waveform shaping by the buffer circuit 501, and are then sent to the head driving board 146.

[Emission Timing Signal]

The emission timing signal (Fire in FIG. 16) is a trigger signal for generating the signal to drive the pressure generation device of the head chip 141.

The emission timing signal is inputted into the ASIC 506 through the buffer 504. In the ASIC 506, the STB 1 through 3, STB CL and LOAD signals used for time-shared drive and multi-gradation drive to be described later are generated, based on the control conditions stored in the register of the nonvolatile memory 502, with the emission timing signal used as a trigger. These signals are sent to the head driving board 146 through the buffer circuit 507. In the same manner, with the emission timing signal used as a trigger, the signal for generating the drive signal of the pressure generation device of the head chip 141 is created, based on the control conditions stored in the register of the nonvolatile memory 502, and is inputted into the drive pulse generating circuits 515 through 518 through the buffer circuit 508. Further, the output signals of the drive pulse generating circuits 515 through 518 are current-amplified by the current amplification circuits 519 and 521, and are turned into the drive ON signals. They are also current-amplified by the current amplification circuits 520 and 522, and are turned into the drive OFF signals, which are then sent to the head driving board 146.

[Transmission and Reception of Control Conditions]

The control conditions having been inputted from the operation section on the control board 4 or the host computer are converted by the control condition generating circuit 403 into the form that can be transferred to the ICB substrate 500, and are sent to the ICB substrate 500. The control conditions are transmitted and received through serial communications by a CS (Chip Select) signal for selecting the ICB substrate 500, a T×D as a transmission line connected commonly to each of the ICB substrates 500, a R×D as a signal receiving line, and a CLK as a clock signal. Each of the CS signals is connected to the ICB substrate. Only the ICB substrate wherein the CS connection thereto is on is enabled to send or receive the control conditions. The structure of sharing a common transmission and reception line (T×D and R×D) makes it possible to reduce the number of wires between the control board 4 and relay substrate 600, and between the relay substrate 600 and ICB substrate 500.

The control conditions are sent to the register of the nonvolatile memory 502 from the control board 4 through the buffer 504 of the ICB substrate 500 and ASIC 506, and are stored therein. They are stored in the nonvolatile memory 502 because the control conditions stored in the register are not lost, even when the power supply is on again after it is once turned off. This arrangement eliminates the need of writing the control conditions every time the power supply is turned off and on. Further, when partial modification of the contents of the register is to be made from the host computer, the contents of the register are read and are sent to the host computer, wherein only the place of modification is rewritten and is sent from the host computer to be written into the register.

FIG. 15 is a diagram showing the control conditions stored in the register of the nonvolatile memory 502.

The address column 800 shows the address of the register, and refers to the location in the word of the register area 32 assigned to the nonvolatile memory 502.

The function column 803 contains the description of control conditions in a digital form. For example, the DALH of the symbol column 802 indicates the voltage value of the drive ON signal for driving the left head chip 141 out of the head chips 141 on the head 10. To be more specific, if the function column 803 contains the description of "160", it refers to 0.1 V/digit as described in the Remarks column 804. Thus, 0.1×160=16.0(V), which denotes that the amplitude of the drive ON signal corresponds to a 16.0 V pulse.

Further, the H_WIDTH of the symbol column 802 indicates the pulse width of the drive ON signal. If the function column 803 contains the description of "30", it refers to 1 μS/digit. Thus, a pulse width of the drive ON signal corresponds to 30 μS.

Actually, the drive ON signal is generated according to the following steps: The digital value 30 having a pulse width stored in the register is read from the register, and a pulse having a width of 30 μS is generated by the ASIC 506 to be inputted into the drive pulse generating circuit 515 through the buffer circuit 508. In the meantime, the digital value of the pulse voltage described in the register—"160", for example,—is read, and is converted into the analog value by the digital-to-analog converter 509. The analog value is inputted into the DC-DC converter as a drive voltage generating circuit 511 where the Vhead is used as a power supply. Thus, a 16-volt voltage is generated and power is supplied to the drive pulse generating circuit 515. The inputted pulse having a width of 30 μS is voltage-amplified to an amplitude of 16.0

V. The pulse having an amplitude of 16 V and a width of 30 μS generated by the drive pulse generating circuit 515 is current-amplified by the current amplification circuit 519, and is turned into the drive ON signal. It is then sent to the head driving board 146 to drive the pressure generation device of the head chip 141.

Accurate voltage adjustment of the drive ON signal is ensured by adjusting the gain and offset of the DC-DC converter as the drive voltage generating circuit 511.

When the function column 803 of the DALL of the symbol column 802 is 80, and the function column 803 having a symbol column 802 of L-WIDTH is 60, the drive OFF signal having a pulse width of 60 μS and an amplitude of 8.0 V is generated by the same operation procedure as that of the aforementioned drive ON signal. This signal is then sent to the head driving board 146. In the aforementioned manner, the drive signal of the pressure generation device is generated, and this signal has a voltage and pulse width conforming to the control conditions stored in the form of a digital value.

In the same manner, various control signals are generated.

(Direction)

In the time-shared drive (to be described later), the Direction signal reverses the order of driving from STB 1, STB 2 and STB 3 to STB 3, STB 2 and STB 1. One Direction signal is assigned to each ICB substrate 500. When the direction of conveying the printing medium P is reversed, the Direction signal will be reversed to adjust the deviation of dots due to the adjacent pressure generation device, whereby normal printing is performed.

(Time-Shared Drive)

The time-shared drive is provided at a position where the adjacent nozzles are displaced in the sub-scanning direction, and emission is driven at timed intervals shifted accordingly. As a result of printing, ink particles emitted from the adjacent nozzles reach the same position on the printing medium in the sub-scanning direction. When the shear mode piezoelectric element subjected to shear deformation is used as a pressure generation device, it is possible to eliminate the adverse effect of the distortion of the adjacent piezoelectric elements by avoiding the simultaneous emission from the adjacent nozzles. It is also possible to distribute the power required for emission.

Figure 16:
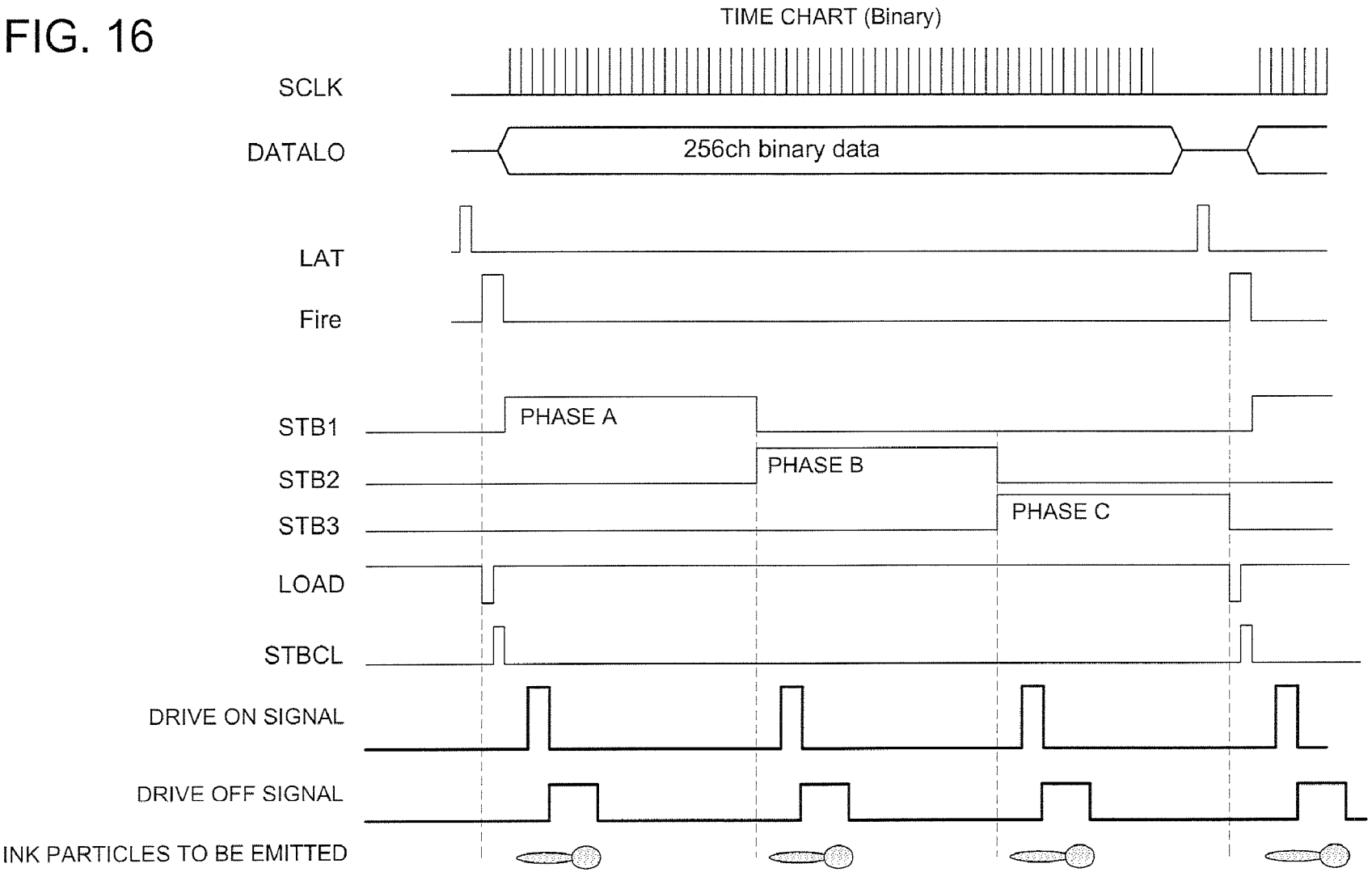
FIG. 16 is a timing chart for driving the head 10 in a time-sharing mode.

FIG. 16 is a timing chart for driving the head 10 in a time-sharing mode.

Figure 18:
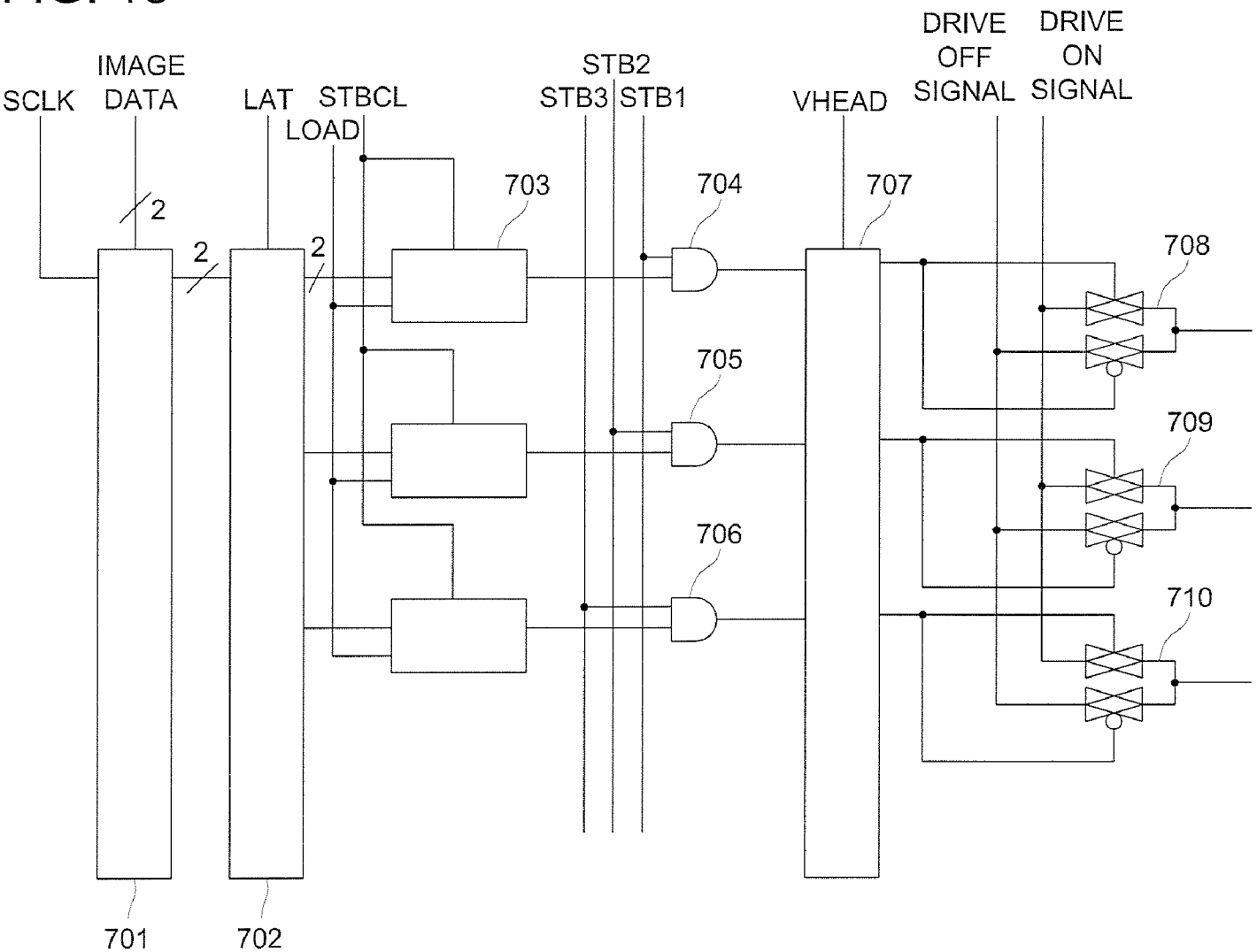
FIG. 18 is an electrical block diagram of the head driving board 146.

FIG. 18 is an electrical block diagram of the head driving board 146.

The following describes the time-shared drive with reference to FIG. 16 and FIG. 18. In the present Example, a three-divided drive system is adopted. An item of image data will be described as one bit (DATAL0).

The image data (DATAL0) is sent to the shift register 701 of the head driving board 146, using a clock signal (SCLK). The head chip 141 is assumed to include 256 pressure generation devices arranged in line. The contents of the shift register 701 are latched into the parallel register 702 by the latch clock signal (LAT). In FIG. 16, the latched image data corresponds to the data having been transferred to the shift register 701 one cycle before the first latch clock signal.

The image data (DATAL0) is latched by the LOAD signal from the parallel register 702, and is transferred into the multi-gradation control section 703. After that, it is outputted to the input terminal of the gates 704 through 706 by the STB CL.

As described above, the drive ON signal and drive OFF signal are generated based on the emission timing signal (Fire) inputted into the ICB substrate 500. Further, the strobe signals STB 1 through STB 3 for time sharing which are applied to another input terminal of the gates 704 through 706 is generated by the register of FIG. 15, based on the value shown in the function column 803 (Phase_LEN and Drop_period). The image data having been gated by the STB 1 through STB 3 is level-shifted by the level shift circuit 707, and is then inputted into the analog switch 708 through 710 together with the drive ON signal and drive OFF signal. After that, it is outputted to the pressure generation device for emitting ink particles. In this way, adjacent pressure generation devices are driven by phase shift in the order of phases A, B and C.

(Multi-Graduation Printing)

Multi-graduation printing is a method of printing to provide gradation by varying the number of ink particles to be emitted per pixel.

Figure 17:
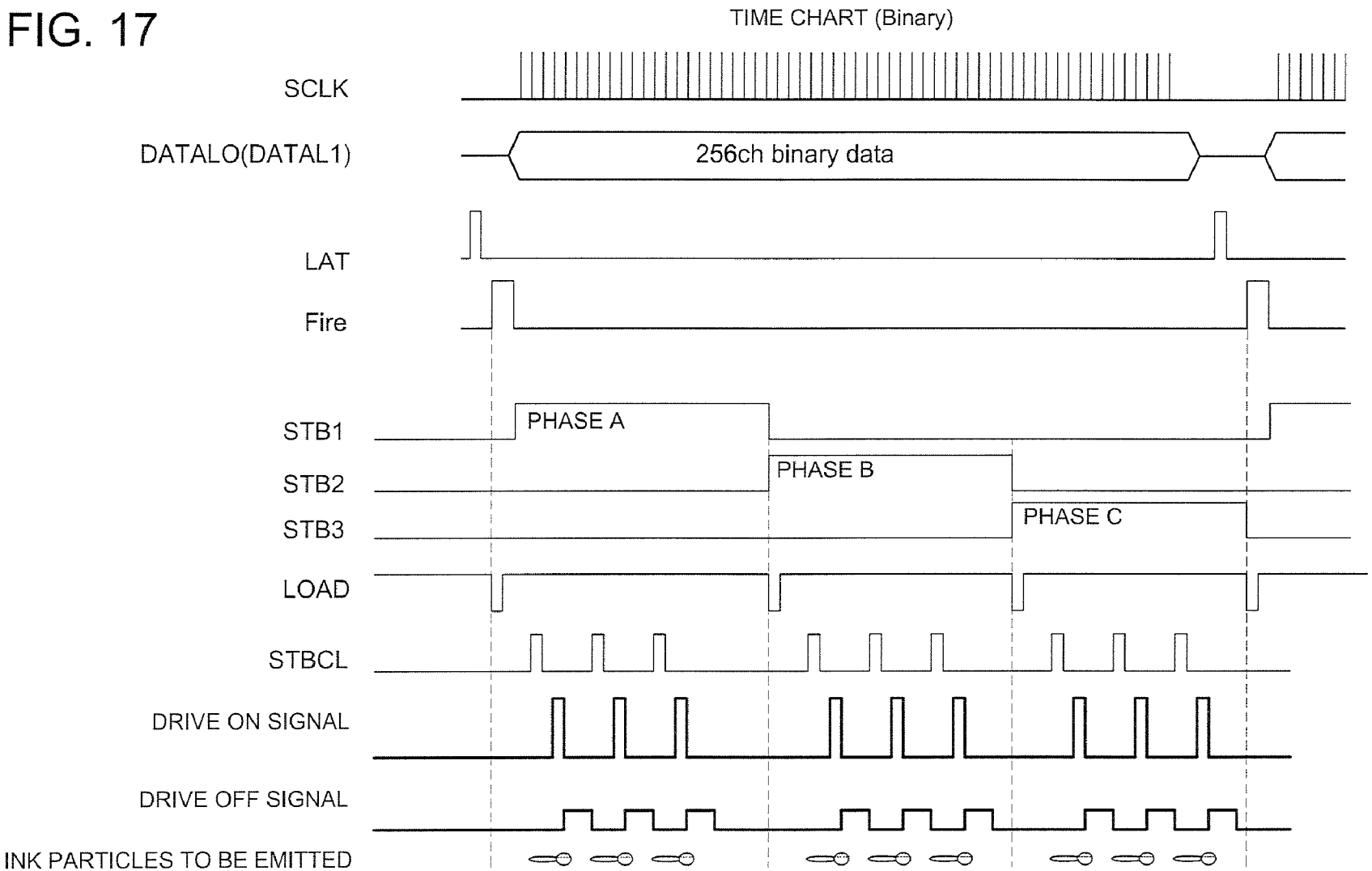
FIG. 17 is a timing chart for driving the head 10 in multi-gradation printing.

FIG. 17 is a timing chart for driving the head 10 in multi-gradation printing.

Referring to FIG. 16, the following describes the multi-graduation printing, using the FIG. 17 and FIG. 18:

In the present Example, two-bit image data is used for multi-graduation printing, by way of an example.

As described above, two-bit image data (DATAL0 and DATAL1) is transferred to the shift register 701 of the head driving board 146. The image data of the shift register 701 is latched into the parallel register 702 by a latch signal (LAT). The image data having been latched by the parallel register 702 is latched into the multi-gradation control section 703 by the LOAD signal. After that, it is counted by the STB CL, and is placed under gradation control. Then it is outputted to the input terminal of the gate 704.

In the register of FIG. 15, the value shown in the function column 803 (GS_LEV) indicates the gradation level. For example, if the value indicated in the function column 803 (GS_LEV) is 1, one gradation is indicated; namely, binary printing (see FIG. 16) is indicated. If the value in the function column 803 (GS_LEV) is 2, two gradations are indicated. Similarly, if the value in the function column 803 (GS_LEV) is 3, three gradations are indicated.

The same number of STB CLs as that of gradation levels is generated.

The function column 803 (N−1) indicates the number of the emission dots for the gradation level 1. For example, when the value in the function column 803 (N−1) is 1, one dot of ink particle is emitted. Similarly, if the value in the function column 803 (N−2) is 3, three dots of ink particles are emitted. If the value in the function column 803 (N−3) is 5, five dots of ink particles are emitted.

In FIG. 17, the gradation level is set at "3", the function column 803 (N−1) at "1", the function column 803 (N−2) at 11211 and the function column 803 (N−3) at "3". This shows that the image data corresponds to DATAL0=1 and DATAL1=1. Since the image data is "11", three dots of ink particles are emitted. Two dots of ink particles are emitted when DATAL0=0 and DATAL1=1. One dot of ink particles is emitted when DATAL0=1 and DATAL1=0.

When the gradation level is set at "3", the function column 803 (N−1) at "1", the function column 803 (N−2) at "3" and the function column 803 (N−3) at "5", and the image data is DATAL0=1 and DATAL1=1, five dots of ink particles are emitted. When DATAL0=0 and DATAL1=1, three dots of ink particles are emitted. When DATAL0=1 and DATAL1=0, one dot of ink particles are emitted.

When the DATAL0=0 and DATAL1=0, zero dot of ink particles, namely, no ink particle is emitted.

The aforementioned multi-graduation printing allows the image to be provided with gradation by varying the amount of ink particles to be emitted per pixel, whereby elaborate image printing is ensured.

(Temperature Control)

The following describes how to control the ink temperature of the head 10:

The output from the temperature sensor (thermister) mounted on the head 10 is received by the buffers 525 and 526, and the buffer 526 output is inputted into one of the input terminals of the comparator 523. The thermistor voltage set value (THM) corresponds to the set temperature stored in the register of the nonvolatile memory 502 is read, and the output having been converted by the digital-to-analog converter 509 is inputted into the other of the input terminals of the comparator 523. The output of the comparator 523 is current-amplified by the current amplifier 524, and the current is sent to the ink heater 149. The ink heater 149 is mounted on each side of the manifold 148 of the head 10. The current flowing into the ink heater 149 heats the ink contained in the manifold 148. When the ink temperature rises so that the output of the temperature sensor rises, the difference from the thermister voltage set value will reduce and the output of the comparator 523 will also reduce. This is accompanied by the reduction in the current flowing to the ink heater 149. Conversely, reduction of the temperature sensor output due to the decrease in ink temperature will increase the difference from the thermister voltage set value, and also increases the output of the comparator 523. Increased output of the comparator 52 will increase the current flowing to the ink heater 149, with the result that ink temperature rises. As described above, the ink temperature is controlled to ensure that the ink temperature will be stabilized at a value close to the set value.

The relationship between the temperature sensor value and thermister voltage set value (THM) should be measured in a test in advance and a predetermined value (thermister voltage set value) corresponding to the ink set temperature should be stored into the register of the nonvolatile memory 502.

The set value should be written into the register through a transmission/reception route located between the aforementioned control board 4 and ICB substrate 500. The thermister voltage set value of the function column 803 in the FIG. 15 is represented in 8-bit data, and is 3.3/256V/digit as described in the Remarks column 804.

The output of the temperature sensor (thermister) mounted on the head 10 is received by the buffer 526. After that, it is converted into the digital value by an analog-to-digital converter 510, and is stored in the function column 803 (THERM) of the register of the nonvolatile memory. This value can be captured into the control board 4 through the transmission/reception route on the side of the aforementioned control board 4. Further, temperature sensor output can be captured into the control board 4 directly in the form of an analog value.

A constant ink viscosity is maintained by ink temperature control, and bending of ink ejection and other failure can be avoided by maintaining a constant amount of ink particles at all times, whereby high-quality printing is provided.

The analog value of the temperature sensor output is captured directly into the control board 4 through the ICB substrate 500. In the event of an abrupt change in the temperature sensor output, this arrangement allows an immediate action to be taken from the control board 4 to give an instruction—e.g. to issue an alarm and to turn off power supply.

Figure 19:
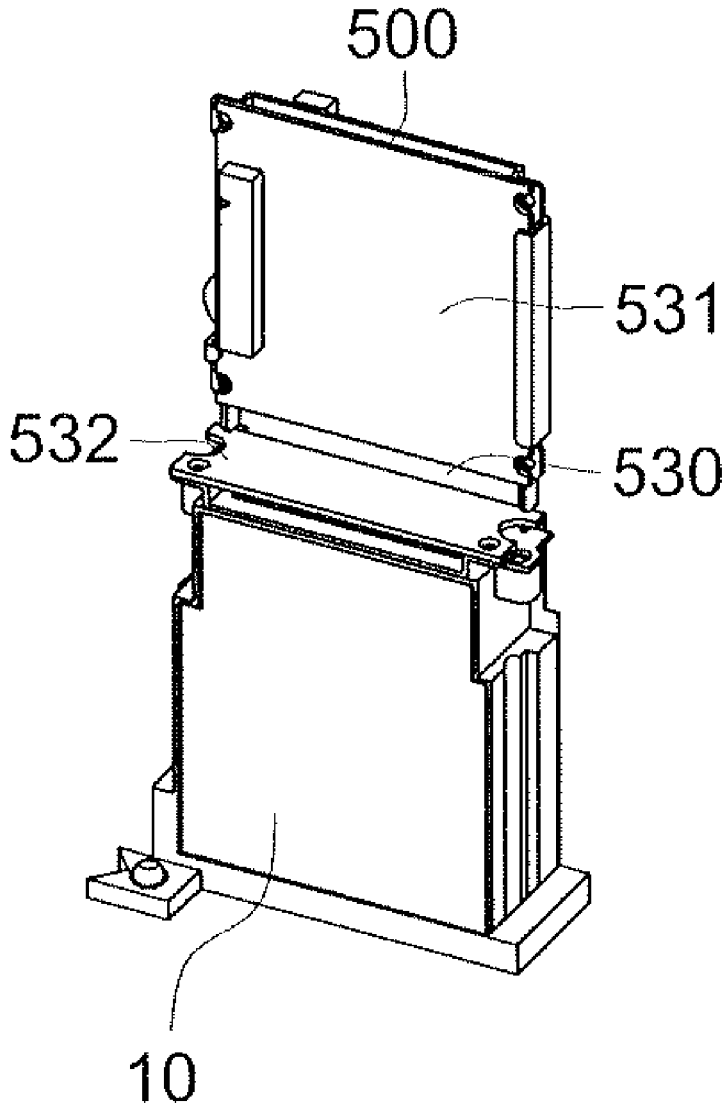
FIG. 19 is a perspective view representing the ICB substrate 500 connected with the head.

FIG. 19 is a perspective view representing the ICB substrate 500 connected with the head 10.

The substrate 500 is designed in such a structure (531) that one of the flexible substrates 530 is sandwiched between two hard substrates (e.g. glass-epoxy substrate). In the same manner, it is designed in such a structure (532) that the other of the flexible substrates also is sandwiched between two hard substrates. The substrate 531 incorporates the electrical circuit of the ICB substrate and the connector with the relay substrate. The signal connected with the head 10 is sent to the other substrate 532 through the flexible substrate. The other substrate 532 incorporates the connector connected with the head 10. In this way, the ICB substrate 500 can be connected to the head driving board 146 of the head 10 having a different mounting position and angle, without using any cable.

The aforementioned Example provides a line head and a line type inkjet printer with this line head capable of high-definition printing in one scanning operation and characterized by compact configuration and high productivity.

The aforementioned Example also provides a line head and a line type inkjet printer with this line head capable of high-definition printing in one scanning operation and characterized by easy positioning among a plurality of heads.

The aforementioned Example further provides a line head and a line type inkjet printer with this line head capable of high-definition printing in one scanning operation and generating a corresponding control signal despite a modification in the type and configuration of the head.

The aforementioned Example furthermore provides a line head and a line type inkjet printer with this line head capable of high-definition printing in one scanning operation and characterized by compact configuration resulting from a reduced number of wires connecting between units.

Although the present invention has been fully described by way of examples with reference to the accompanying drawings, it is to be noted that various changes and modifications with be apparent to those skilled in the art. Therefore, unless such changes and modifications depart from the scope of the present invention, they should be construed as being included therein.

What is claimed is:

1. An inkjet printer comprising:

a line head made up of a plurality of heads having a plurality of nozzles for emitting ink particles, said heads being installed in a staggered arrangement;

a plurality of drive signal generating circuits, one of each of the drive signal generating circuits provided for each of the heads to output a drive signal to each of the heads; and a relay board for receiving image data, a control signal conforming to each of the heads, and a timing signal for determining timed intervals to emit ink particles from the control unit of the inkjet printer, and for sending the received image data, control signal and timing signal to said plurality of respective drive signal generating circuits, wherein said relay board is arranged parallel to said drive signal generating circuit.

* * * * *